US008297370B2

(12) United States Patent
Wilkins et al.

(10) Patent No.: US 8,297,370 B2
(45) Date of Patent: Oct. 30, 2012

(54) RELEASING CONTROL UNIT FOR A RESIDENTIAL FIRE PROTECTION SYSTEM

(75) Inventors: Roger S. Wilkins, Warwick, RI (US); James E. Golinveaux, N. Kingstown, RI (US); Mark E. Fessenden, Warwick, RI (US)

(73) Assignee: Tyco Fire Products LP, Lansdale, PA (US)

( * ) Notice: Subject to any disclaimer, the term of this patent is extended or adjusted under 35 U.S.C. 154(b) by 624 days.

(21) Appl. No.: 11/916,419

(22) PCT Filed: Jun. 5, 2006

(86) PCT No.: PCT/US2006/021683

§ 371 (c)(1),
(2), (4) Date: Jun. 30, 2008

(87) PCT Pub. No.: WO2006/133058

PCT Pub. Date: Dec. 14, 2006

(65) Prior Publication Data

US 2008/0277125 A1 Nov. 13, 2008

Related U.S. Application Data

(60) Provisional application No. 60/687,656, filed on Jun. 3, 2005.

(51) Int. Cl.

| | |
|---|---|
| ***A62C 35/00*** | (2006.01) |
| ***A62C 37/36*** | (2006.01) |
| ***A62C 2/00*** | (2006.01) |
| ***A62C 3/06*** | (2006.01) |
| ***A62C 37/10*** | (2006.01) |

(52) U.S. Cl. ..... 169/17; 169/16; 169/20; 169/43; 169/56; 169/60; 169/61

(58) Field of Classification Search ..... 169/16, 169/17, 18, 19, 20, 23, 43, 46, 51, 56, 60, 169/61

See application file for complete search history.

(56) References Cited

U.S. PATENT DOCUMENTS 5,027,905 A 7/1991 Cousineau (Continued)

FOREIGN PATENT DOCUMENTS

WO WO 02/15981 A1 2/2002

OTHER PUBLICATIONS

U.S. Appl. No. 10/874,757 to Golinveaux, filed Jun. 24, 2004 (Abandoned).

(Continued)

*Primary Examiner* — Len Tran
*Assistant Examiner* — Ryan Reis
(74) *Attorney, Agent, or Firm* — Perkins Coie LLP

(57) ABSTRACT

A releasing control panel (RCP) for use with residential fire protection systems and methods. The RCP provides a primary communication between a liquid supply source and a network of pipes and sprinklers using a series of three control valves. The RCP also encloses a pressure source providing pressurized gas to an auxiliary line that is isolated from the pipe network and sprinklers, with pressurized gas being provided in response to a pressure in the isolated auxiliary line. The RCP also encloses a secondary communication between the series of the control valves and a drain without the use of a bypass system for the primary communication. The RCP further encloses a power supply and a controller that communications with a fire detector disposed in a dwelling at a defined spacing to a sprinkler.

80 Claims, 7 Drawing Sheets

U.S. PATENT DOCUMENTS

| | | | | |
|---|---|---|---|---|
| 5,099,925 | A | 3/1992 | Glidden | |
| 5,236,049 | A | 8/1993 | Asselin et al. | |
| 5,720,351 | A | 2/1998 | Beukema et al. | |
| 5,864,287 | A | 1/1999 | Evans, Jr. | |
| 5,927,406 | A | 7/1999 | Kadoche | |
| 5,971,080 | A * | 10/1999 | Loh et al. | 169/43 |
| 5,992,532 | A | 11/1999 | Ramsey et al. | |
| 6,076,545 | A | 6/2000 | Cooper | |
| 6,357,531 | B1 | 3/2002 | Asselin | |
| 6,601,604 | B1 | 8/2003 | Cooper | |
| 6,634,373 | B1 | 10/2003 | Nilsen | |
| 6,810,910 | B2 | 11/2004 | McHugh | |
| 6,848,513 | B2 * | 2/2005 | Jackson et al. | 169/19 |
| 6,857,478 | B1 | 2/2005 | Weber | |
| 7,055,612 | B2 | 6/2006 | Jackson | |
| 7,185,711 | B2 | 3/2007 | Jackson | |
| 7,237,568 | B2 | 7/2007 | Cooper | |
| 7,383,892 | B2 | 6/2008 | Jackson | |
| 2005/0284645 | A1 | 12/2005 | Golinveaux | |
| 2006/0021759 | A1 * | 2/2006 | Golinveaux | 169/17 |
| 2006/0021760 | A1 | 2/2006 | Golinveaux | |
| 2006/0021761 | A1 | 2/2006 | Golinveaux | |
| 2006/0021762 | A1 | 2/2006 | Golinveaux | |
| 2006/0021763 | A1 | 2/2006 | Golinveaux | |
| 2006/0021765 | A1 | 2/2006 | Golinveaux | |
| 2006/0021766 | A1 | 2/2006 | Golinveaux | |
| 2007/0221388 | A1 | 9/2007 | Johnson | |

OTHER PUBLICATIONS

Examination Report issued in co-pending New Zealand Application No. 563960, Sep. 14, 2009, 2 pages.

Examination Report issued in co-pending Australian Application No. 2006255189, Jun. 1, 2010, 4 pages.

Mar. 10, 2009 Intl Preliminary Report on Patentability issued in Intl Application No. PCT/US06/021683, including the May 6, 2008 Written Opinion of the ISA.

May 6, 2008 International Search Report issued in International Application No. PCT/US2006/021683.

Specification Sheet for Model PDRP-1001 PreAction/Deluge Control Panel provided by System Sensor of Honeywell International, Inc., Dec. 1997. (2 pages).

U.S. Appl. No. 10/874,757, filed Jun. 24, 2004, Golinveaux.

* cited by examiner

RELEASING CONTROL UNIT FOR A RESIDENTIAL FIRE PROTECTION SYSTEM

PRIORITY DATA AND INCORPORATION BY REFERENCE

This application is a 35 U.S.C. 371 application of PCT/US2006/021683, filed Jun. 5, 2006, which claims priority to U.S. Provisional Patent Application Ser. No. 60/687,656, filed Jun. 3, 2005, the entireties of which are hereby incorporated by reference.

TECHNICAL FIELD

This invention relates generally to the residential sprinkler system controls. More specifically, the present invention provides a releasing control panel for controlling the release of a fire fighting fluid into a network of pipes of a residential sprinkler system.

BACKGROUND OF THE INVENTION

An automatic sprinkler system is one of the most widely used devices for fire protection. These systems have sprinklers that are activated once the ambient temperature in an environment, such as a room or a building, exceeds a predetermined value. Once activated, the sprinklers distribute fire-extinguishing fluid, preferably water, in the room or building. A fire sprinkler system, depending on its specified configuration, is considered effective if it controls or suppresses a fire.

The sprinkler system can be provided with a water supply (e.g., a reservoir or a municipal water supply). Such supply may be separate from that used by a fire department. Regardless of the type of supply, the sprinkler system is provided with a main that enters the building to supply a riser. Connected at the riser are valves, meters, and, preferably, an alarm to sound when the system activates. Downstream of the riser, a usually horizontally disposed array of pipes extends throughout the fire compartment in the building. Other risers may feed distribution networks to systems in adjacent fire compartments. Compartmentalization can divide a large building horizontally, on a single floor, and vertically, floor to floor. Thus, several sprinkler systems may serve one building.

In a piping distribution network, branch lines carry the sprinklers. A sprinkler may extend up from a branch line, placing the sprinkler relatively close to the ceiling, a sprinkler can be pendent below the branch line, or a sprinkler can be horizontal from the branch line. For use with concealed piping, flush-mounted sprinklers may extend only slightly below a ceiling or beyond a wall.

The sprinkler system can be provided in various configurations. In a wet-pipe system, used for example, in buildings having heated spaces for piping branch lines, all the system pipes contain a fire-fighting liquid, such as, water for immediate release through any sprinkler that is activated. In a dry-pipe system, used for example, in unheated open areas, cold rooms, passageways, or other areas exposed to freezing, such as unheated buildings in freezing climates or for cold-storage rooms, the pipes, risers, and feed mains, branch lines and other distribution pipes of the fire protection system may contain a dry gas (air or nitrogen or mixtures thereof) under pressure. A valve is used to separate the pipes that contain a dry gas and pipes that contain a fire-fighting liquid, such as, water. In some application, the pressure of gas holds closed a dry-pipe valve at the riser. When heat from a fire activates a sprinkler, the gas escapes from the branch lines and the dry-pipe valve trips; water enters branch lines; and fire fighting begins as the sprinkler distributes the water. By its nature, a dry sprinkler system is slower to respond to fire conditions than a wet system because the dry gas must first be exhausted from the system before the fire-fighting liquid is expelled from the fire sprinkler. Such delay creates a "water delivery time" to the sprinkler. The water delivery time introduces an additional variable for consideration in a design for fire protection with a dry pipe system.

Various standards exist for the design and installation of a fire protection system. In particular, the National Fire Protection Association ("NFPA") describes, in its *Standard for the Installation of Sprinkler Systems* 13 (2002) ("the NFPA Standard 13 (2002)") various design consideration and installation parameters for a fire protection system, which standard is incorporated herein by reference in its entirety. One of many design considerations provided by NFPA Standard 13 is the water demand. For a wet system, the NFPA Standard 13 (2002) describes at 11.2.3.1.5 a density/area approach and at 11.2.2 a pipe schedule method.

NFPA Standard 13 (2002) also addresses certain design considerations for dry pipe fire protection systems by modifying the design of the wet pipe system. For example, in a dry pipe system, NFPA Standard 13 (2002) states, for commercial storage (NFPA Standard 13, 12.1.6.1) and dry pipe system generally (NFPA Standard 13,11.2.3.2.5), that a design area for a dry pipe system is to be increased 30% over the design area for the wet system in such applications so that the minimum quantity of fire sprinklers being hydraulically calculated for a dry pipe system is increased by generally 30% over the same quantity of fire sprinklers in a wet system. Where Large-Drop Sprinklers are utilized in commercial fire protection, NFPA shows (at Table 12.3.2.2.1(a) and 12.3.4.2.1) that an increase in the specified number of sprinklers (e.g., 50% or more) is required when a dry pipe system is utilized instead of a wet pipe for these sprinklers. When a commercial fire sprinkler is used with a dry pipe instead of a wet pipe system in dwelling applications, the design area must be increased by 30% so that the number of these sprinklers must be increased, and thus, the hydraulic demand is increased. It is apparent from NFPA Standard 13 (2002) that, holding all other design parameters constant, the use of a dry pipe system instead of a wet pipe system would require a relatively large increase in the number of hydraulically calculated fire sprinklers, which would increase the hydraulic demand of the dry pipe system.

Although NFPA Standard 13 (2002) refers in broad terms to wet pipe and dry pipe systems, NFPA Standard 13 (2002) is generally silent as to design and installation criteria for dry pipe residential sprinkler systems. For example, NFPA Standard 13 (2002) fails to specify any criteria in a design of a dry pipe residential fire sprinkler system, including a hydraulic demand calculation, the quantity of residential fire sprinklers consonant with the hydraulic demand calculation or installation constraints and use of residential fire sprinklers in a dry pipe fire protection system. In fact, NFPA Standard 13 (2002) specifically prohibits residential fire sprinklers from being used in any system other than wet unless the residential fire sprinklers are listed for such other applications, as stated in NFPA Standard 13 at 8.4.5.2:

> [R]esidential sprinklers shall be used only in wet systems unless specifically listed for use in dry pipe systems or pre-action systems.

(Emphasis Added). NFPA provides separate standards for design and installation of wet pipe fire protection system in residential occupancies. Starting in 1975, NFPA provided the *Standard for the Installation of Sprinkler Systems in One-And Two-Family Dwellings and Manufactured Homes* 13D ("NFPA Standard 13D"). Due in part to the increasingly urbanized nature of cities, NFPA promulgated, in 1989, another standard in recognition of low-rise residential facilities, entitled *Standard for the Installation of Sprinkler Systems in Residential Occupancies Up to And Including Four Stories in Height* 13*R* ("NFPA Standard 13R"). The latest respective editions of NFPA Standard 13D and 13R are the 2002 Edition of NFPA Standard 13 and 13R, which are incorporated by reference herein in their entirety. Underwriters Laboratory ("UL") provides for additional requirements that residential fire sprinklers must meet for residential fire protection systems as set forth in its *Underwriter's Laboratory Residential Fire Sprinklers for Fire-Protection Service* 1626 ("UL Standard 1626"). The most recent edition of UL Standard 1626 is the Oct. 2003 edition, which is incorporated by reference herein in its entirety.

The NFPA and UL Standards provide similar water density requirement for residential fire protection systems. NFPA Standard 13 (2002) states (Chap 11.2.3.5.2) that a density for a protection area of a residential occupancy with a generally flat ceiling is the greater of (a) 0.1 gallons per minute per square feet of the four most hydraulically demanding sprinkler over a design area or (b) a listed residential minimum density. The listed residential minimum density can be found in either NFPA Standard 13D or 13R (2002). NFPA Standard 13D (2002) states (Chapter SA.1.2.2 and 8.1.2) that fire sprinklers listed for residential use shall have minimum discharge density of 0.05 gallons per minute per square feet to the design sprinklers, where the number of design sprinklers includes all of the sprinklers, up to a maximum of two, that requires the greatest hydraulic demand, within a compartment that has generally flat and smooth ceiling. NFPA Standard 13R (2002) states (Chapter 6.7.1.1.2.2. and 6.7.1.2) that fire sprinklers listed for residential use shall have minimum discharge density of 0.05 gallons per minute per square feet to the design sprinklers, where the number of design sprinklers includes all of the sprinklers, up to a maximum of four, that requires the greatest hydraulic demand, within a compartment that has generally flat and smooth ceiling. UL Standard 1626 (Oct. 2003), on the other hand, states (at Table 6.1) that the density for a coverage area with a generally flat ceiling as 0.05 gallons per minute per square feet minimum.

Although NFPA Standards 13R and 13D provide considerable flexibility in the design and installation of wet pipe residential fire protection systems, these standards are strict in prohibiting any existing residential fire sprinklers that are approved for use in a wet pipe residential system from being used in any application other than a wet system. In particular, both NFPA Standard 13R and 13D (2002) reiterate the stricture stated NFPA Standard 13 (2002), which prohibits the use of residential sprinklers for systems other than wet pipe by stating, at paragraphs 6.6.7.1.2 and 7.5.2, respectively, that:

> [R]esidential sprinklers shall not be used on systems other than wet pipe systems unless specifically listed for use on that particular type of system.

(Emphasis Added). While these standards may have considered a residential piping system other than a wet pipe system, e.g., a dry pipe residential system, the standards do not provide any indication of how to determine a hydraulic demand as part of a design of such systems. Furthermore, because of the guidelines in the standards regarding the use of dry pipe instead of wet pipe, those desiring to use a dry pipe sprinkler system in non-residential applications would normally increase the hydraulic demand of the dry pipe system over that of the wet pipe system, either by an increase in the design area or the number of sprinklers based on the wet pipe system.

In addition to the failure of the NFPA and UL Standards to provide any direction on a hydraulic design calculation for a dry type residential sprinkler system, these Standards also fail to provide any guidance on how a dry type residential fire sprinkler protection system design would be controlled and monitored in residential applications. However there are patent publications that provide such guidance. For example, the following patent publications provide guidance regarding dry residential sprinkler systems: (i) U.S. Patent Publication No. 20050284645; U.S. patent application Ser. No. 10/874,758, entitled "Residential dry sprinkler design method and system;" (ii) U.S. Patent Publication No. 20060021763; U.S. patent application Ser. No. 10/899,129, entitled "Non-interlock, non-preaction residential dry sprinkler fire protection system with alarm;" (iii) U.S. Patent Publication No. 20060021761; U.S. patent application Ser. No. 10/899,053, entitled "Non-interlock, non-preaction residential dry sprinkler fire protection system with a releasing control panel;" (iv) U.S. Patent Publication No. 20060021759; U.S. patent application Ser. No. 10/898,923, entitled "Non-interlock, preaction residential dry sprinkler fire protection system with a releasing control panel;" (v) U.S. Patent Publication No. 20060021760; U.S. patent application Ser. No. 10/898,924, entitled "Single interlock, preaction residential dry sprinkler fire protection system with a releasing control panel;" (vi) U.S. Patent Publication No. 20060021762; U.S. patent application Ser. No. 10/899,124, entitled "Double interlock, preaction residential dry sprinkler fire protection system with a releasing control panel;" (vii) U.S. Patent Publication No. 20060021766; U.S. patent application Ser. No. 10/899,131, entitled "Residential dry sprinkler design method and system with fire resistant plastic components;" (viii) U.S. Patent Publication No. 20060021765; U.S. patent application Ser. No. 10/899,128, entitled "Residential dry sprinkler design method and system with wet main pipe and fire resistant plastic dry branch pipes," each of which is incorporated herein by reference in their entirety.

It is believed that there are known control panels for a dry type fire protection system that are based on commercial and/or residential fire protection type control panels. For example, U.S. Pat. No. 5,720,351 (the '351 patent) is directed to fire protection preaction deluge control arrangements. The '351 patent shows and describes the exposed arrangement as including a control panel arranged to receive signals from a plurality of detectors and from an emergency switch to supply control signals to a solenoid control valve. In addition, the control arrangement of the '351 patent provides for a riser assembly to bypass the solenoid control valve and a manual emergency valve to operate the arrangement without the solenoid control valve. In-line with the bypass is another manual valve and a drain line. The '351 patent also provides for sprinkler line damage detection using an air compressor and alarm. According to the '351 patent, the control arrangement purports to eliminate the complex riser assembly to operate the control valve. The '351 patent also eliminates the need for a check valve or any other cut-off device at the outlet of the control valve.

While known control panels may be used to control a residential fire protection system, it is believed that none of the known control panels: (1) integrate a control module, air supply source, pressure sensors, and control valves and associated fluid connections in a single enclosure; (2) control various operational modes of a residential fire protection system that specifically uses residential fire sprinklers based on a specified hydraulic design calculation; (3) a pipe arrangement in which the control valve can be test operated and isolated from the connected sprinkler system; and (4) a control valve arrangement configured as a life safety arrangement. Thus, the design methodologies, installation requirements, and control of a fire protection system in residential applications with residential fire sprinklers, other than a wet pipe system, are believed to be notably lacking.

DISCLOSURE OF INVENTION

In one aspect of the present invention, a control panel that houses all associated control components for a residential dry sprinkler system such as a control valve, air compressor pressure sensors, and pipe connections, is provided to control the operation of the residential dry sprinkler system that uses residential sprinklers in the system. By virtue of the control panel, at least one method to detect fault in a residential fire protection system is provided.

In particular, in one aspect of the present invention, a fire control panel for a fire protection system in a residential dwelling unit as defined in the 2002 Edition of the National Fire Protection Association Standards 13, 13D and 13R is provided. The fire control panel includes a main connection, control valve, system connection, auxiliary pipe, at least a first sensor, gas supply source and an isolation valve. The actuated control valve is disposed in the housing. The control valve has an inlet and an outlet and includes a closure member disposed in a normally closed position to prevent liquid flow through the control valve and in an actuated position by an actuator to permit liquid flow from the inlet to the outlet through the control valve. The main connection is in fluid communication with the inlet of the control valve. The main connection has an internal surface that defines a first flow passage along a first flow axis, the first flow passage defining a first inside diameter about the first flow axis of less than two inches. The system connection has an internal surface that defines a second flow passage along a second flow axis. The second flow passage has a second inside diameter about the second flow axis of less than two inches. The system connection is in fluid communication with the outlet of the control valve so that when the control valve is actuated, the system connection is in fluid communication with the main connection. The gas supply source provides gas at various pressures. The first sensor is disposed in the housing and coupled to the system connection to provide a first indicator of a magnitude of pressure in the system connection. A second sensor can be disposed in the housing and coupled to the auxiliary pipe to provide a second indicator of a magnitude of pressure in the auxiliary pipe. The isolation valve isolates fluid communication from the system connection to the gas supply source.

In another aspect of the present invention, a fire control panel for a residential dwelling unit as defined in the 2002 Edition of the National Fire Protection Association Standard 13, 13R, and 13D is provided. The fire control panel includes a housing, a control valve, more preferably a control valve, a first sensor, a second sensor, a main connection, and a system connections. The control valve has an inlet and an outlet. The control valve includes a closure member disposed in a normally closed position to prevent liquid flow through the control valve and in an actuated position by a solenoid actuator to permit liquid flow from the inlet to the outlet through the control valve. The main connection is disposed in the housing and connectable to a pressurized fire-fighting liquid source. The control valve is coupled to the main connection in a normally-closed state that prevents liquid flow through the control valve. The system connection is disposed in the housing and coupled to the control valve so that when the control valve is actuated, the system connection is in fluid communication with the main connection. The auxiliary pipe is coupled to a pressurized gas source at one end of the auxiliary pipe and in fluid communication with the system connection at the other end of the auxiliary pipe so that the auxiliary pipe and the system connection are capable of being filled with pressurized gas from the pressurized gas source. The first sensor is disposed in the housing and coupled to the system connection to provide a first indicator of a magnitude of pressure in the system connection. The second sensor is disposed in the housing and coupled to the auxiliary pipe to provide a second indicator of a magnitude of pressure in the auxiliary pipe.

In a further aspect of the present invention, a method of determining fault in a residential fire control system is provided. The system has a network of dry pipes in fluid communication with respective bodies of residential fire sprinklers and a control panel, the control panel has a housing, a control valve coupled to a main connection, a system connection coupled to the control valve, an auxiliary pipe coupled to a selectively operable gas supply source at one end of the auxiliary pipe and in fluid communication with the system connection at the other end of the auxiliary pipe, the control panel being connected to a fire detection device, first and second sensors. The method can be achieved by: isolating the gas supply from the system connection; and indicating a fault condition in the fire protection system when gas pressure in the body of the plurality of residential fire sprinklers is below a first magnitude.

Another aspect of the present invention provides for a residential fire control panel that includes a housing and a first manual control valve and a second manual control valve located within the housing. Each valve has an outlet and an inlet, the inlet of the first manual control valve is preferably configured for communication with a fluid main and the outlet of the second manual control valve is preferably configured for communication with a network of pipes having at least one sprinkler. A normally-closed solenoid valve is preferably disposed within the housing between the first and second manual control valves to provide communication between the outlet of the first manual control valve and the inlet of the second manual control valve. The panel further preferably includes a compressed air conduit in communication with the inlet of the second manual control valve. In addition, the panel includes an air compressor disposed within the housing in communication with the compressed air conduit to provided a supply of pressurized air. A first pressure switch is preferably included to detect an air pressure in the compressed air conduit outside a range of pressures and a second pressure switch to maintain the supply of pressurized air in a second range of pressures. The second pressure switch is preferably in communication with the air compressor. The panel also preferably includes a controller coupled to a power source and having at least one input for receiving a low pressure signal and a high pressure signal. The controller is preferably in communication with at least one alarm to actuate the at least one alarm upon the controller receiving a signal of at least one of the low and high pressure signal.

Another aspect of the present invention provides a method of using a residential fire control panel having a housing disposed between a main source of fluid and a branch pipe of a residential sprinkler system. The method preferably includes pressurizing the branch pipe with a pressurized gas from a gas source located within the housing and isolating the fluid main from the gas source. In addition, the method preferably includes sensing a low pressure in the branch pipe from a sensor disposed in the housing and controlling introduction of fluid from the main source into the branch pipe through the control panel in response to the low pressure.

In yet another aspect according to the present invention, provided is a residential unit fire protection system for a residential dwelling unit having at least one dwelling as defined in the 2002 Edition of the National Fire Protection Association Standards 13, 13D and 13R. The fire protection system preferably includes a liquid supply source along a main line and a network of pipes including a first branch in communication with the at least one dwelling the first branch including at least one sprinkler to discharge a fluid over the at least one dwelling area within about fifteen seconds of sprinkler activation. In addition, the system includes at least one fire control panel disposed between the main line and the branch pipe. The at least one fire control panel preferably includes a housing having a normally closed control valve disposed in the housing, the control valve having an inlet and an outlet and a sensor disposed in the housing and coupled to the system connection to detect a threshold reduction in the system pressure. The system can further include at least one fire detector disposed in the at least one dwelling and in communication with the at least one fire control panel. In another preferred embodiment of the system, the dwelling unit includes at least a second dwelling and the network of pipes includes a second branch pipe having at least one sprinkler in communication with the at least second dwelling. The system further preferably includes at least a second fire control panel disposed between the main line and the second branch pipe. The first control panel is preferably in exclusive communication with the first branch and the second fire control panel is preferably in exclusive communication with the second branch so as to provide sectional control to the first and at least second dwellings.

In an alternative embodiment of the preferred system, provided is a liquid supply source along a main line and a network of pipes including a first branch in communication with the at least one dwelling the first branch including at least one sprinkler to discharge a fluid over the at least one dwelling area within about fifteen seconds of sprinkler activation. In addition, the system includes at least one fire control panel disposed between the main line and the branch pipe and at least one detector spaced from the sprinkler at a defined sprinkler-to-detector spacing. The at least one detector can be a rate of temperature rise heat detector having and the sprinkler-to-detector spacing is about eight feet, or alternatively be a fixed temperature heat detector having and the sprinkler-to-detector spacing is about three feet.

Accordingly, also provided in another aspect a sprinkler preferably including a body having an inlet and an outlet spaced apart along a longitudinal axis and a deflector assembly substantially axially aligned with the outlet for deflecting a fluid discharge. The deflector assembly preferably includes a first position distal the outlet and a second position distal the first position. Also included is a cover plate assembly for supporting the deflector assembly in the first position and a support assembly disposed about at least a portion of the body. Preferably provided are means for detecting displacement of the cover plate and generating a signal in response to the detection of displacement.

In yet another aspect of the present invention, provided is a method for identifying a detector to sprinkler spacing in a residential preaction sprinkler system. The method preferably includes identifying a detector for use in a compartment of a dwelling having at least one sprinkler and identifying a spacing to locate the detector from the sprinkler such that detector activates prior to the sprinkler in the presence of a fire in the compartment.

BRIEF DESCRIPTIONS OF THE DRAWINGS

The accompanying drawings, which are incorporated herein and constitute part of this specification, illustrate exemplary embodiments of the invention, and, together with the general description given above and the detailed description given below, serve to explain the features of the invention.

MODE(S) FOR CARRYING OUT THE INVENTION

Figure 1:
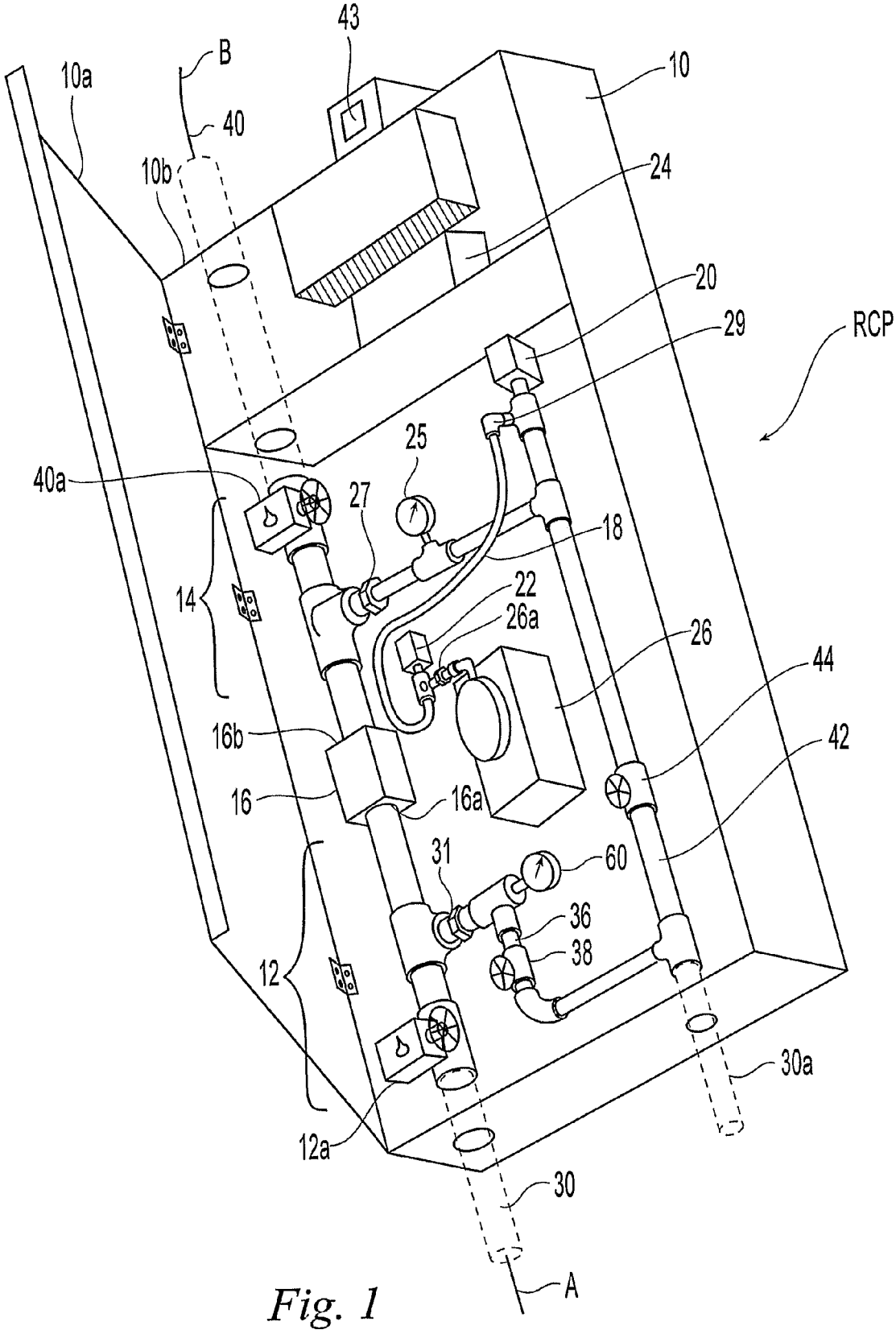
FIG. 1 is a perspective view of a preferred embodiment of a control panel.
Figure 2:
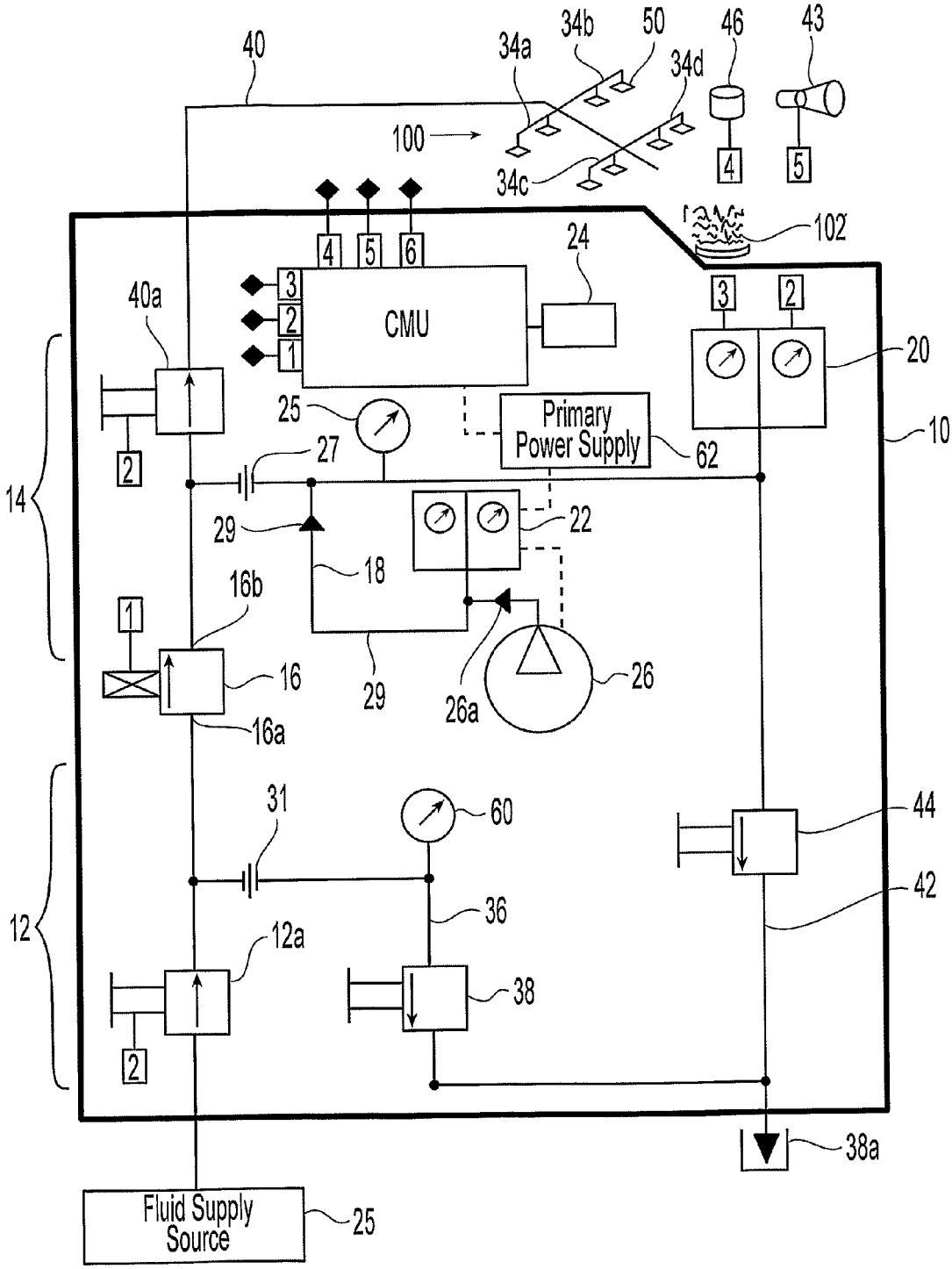
FIG. 2 is a schematic view of a preferred system that implements the control panel of FIG. 1.

FIGS. 1 and 2 illustrate the preferred embodiments. In particular, FIG. 1 illustrates a releasing control panel ("RCP") for a fire protection system 100 in a residential application. As used herein, the term "residential" indicates a dwelling unit as defined in the 2002 Edition of the NFPA Standard 13, and similarly in the 2002 Edition of NFPA 13D and 13R, which can include commercial dwelling units (e.g., rental apartments, lodging and rooming houses, board and care facilities, hospitals, motels or hotels), to indicate one or more rooms, arranged for the use of individuals living together, as in a single housekeeping unit, that normally has cooking, living, sanitary, and sleeping facilities. The dwelling unit normally includes a plurality of compartments as defined in NFPA Standard 13, where generally each compartment is a space that is enclosed by walls and ceiling. The standards relating to residential fire protection, as promulgated by the National Fire Protection Association ("NFPA Standard 13 (2002)", "NFPA Standard 13D (2002)", "NFPA Standard 13R (2002)") are incorporated herein by reference in their entireties. It is to be understood that the RCP and the systems and/or devices associated therewith as described herein are applicable to compartments, enclosures, or occupancies equivalent in nature having fire protection needs equivalent to residential applications.

The fire control panel RCP preferably includes a main connection 12, system connection 14, control valve 16 coupled to the main and system connections to define a valve manifold control. The valve manifold control is further preferably coupled to an auxiliary pipe 18, and first and second sensors 20 and 22. The RCP also preferably includes a housing 10 surrounding a volume that encloses the coupled manifold, auxiliary pipe and sensors.

The housing 10 can include a door 10*a* coupled to a base 10*b*. The housing 10 is preferably formed from sheet steel having a width of about 14 inches, length of about 50 inches and depth of about 8 inches for a total volume of about 5600 cubic inches. The total volume can be subdivided into smaller volumes. One of the smaller volumes surrounds a portable power supply unit 24. Preferably, the total volume surrounds and protects respective portions of the portable power supply unit 24, control valve 16, auxiliary pipe 18, pressurized gas source 26, first and second sensor 20 and 22, main connection 12, controller CMU, and the system connection 14.

The main connection 12 is connectable via a manual control valve 12*a* to a pressurized fire-fighting liquid source such as, for example, water via a riser 30. In the preferred embodiment, the main connection 12 is a pipe with an internal surface that defines a first flow passage along a first flow axis A. The system connection 14 is connectable via a control valve 40*a* to a gas pipe 40 which can be further in communication with branch pipes of a residential sprinkler system. The control valve 40*a* is preferably a manual control valve. The control valve 40*a* can facilitate system testing without filling the fire protection system 100 or the coverage area with water by isolating the system 100 from the liquid source. The system connection 14 includes a pipe with an internal surface that defines a second flow passage along a second flow axis. Preferably, the internal surface of the respective flow passages has a generally circular inner surface with an inside diameter of about 1.5 inches with respect to the flow axes. More preferably, the inside diameter is 1.0 inch.

Although the preferred embodiments utilize an internal surface with a circular cross-sectional area, other non-circular cross-sectional areas can also be utilized. In particular, the first or second flow passage has a cross-sectional area generally orthogonal to the flow axis of preferably less than 4.9 square inches. Further, the first cross-sectional area and the second cross-sectional area each has preferably a cross-sectional area of either 1.8 square inches and 3.1 square inches.

The control valve 16 is preferably coupled to the main connection 12 in a normally-closed state that prevents liquid flow through the control valve 16. Preferably, the control valve 16 is disposed between the manual control valve 12*a* and the control valve 40*a*. In one preferred embodiment of the RCP, the control valve 40*a* is a manual control valve disposed just upstream of the control valve 16 to provide selective isolation of the gas pipe 40 when, for example, performing maintenance on the control valve 16.

Figure 2A:
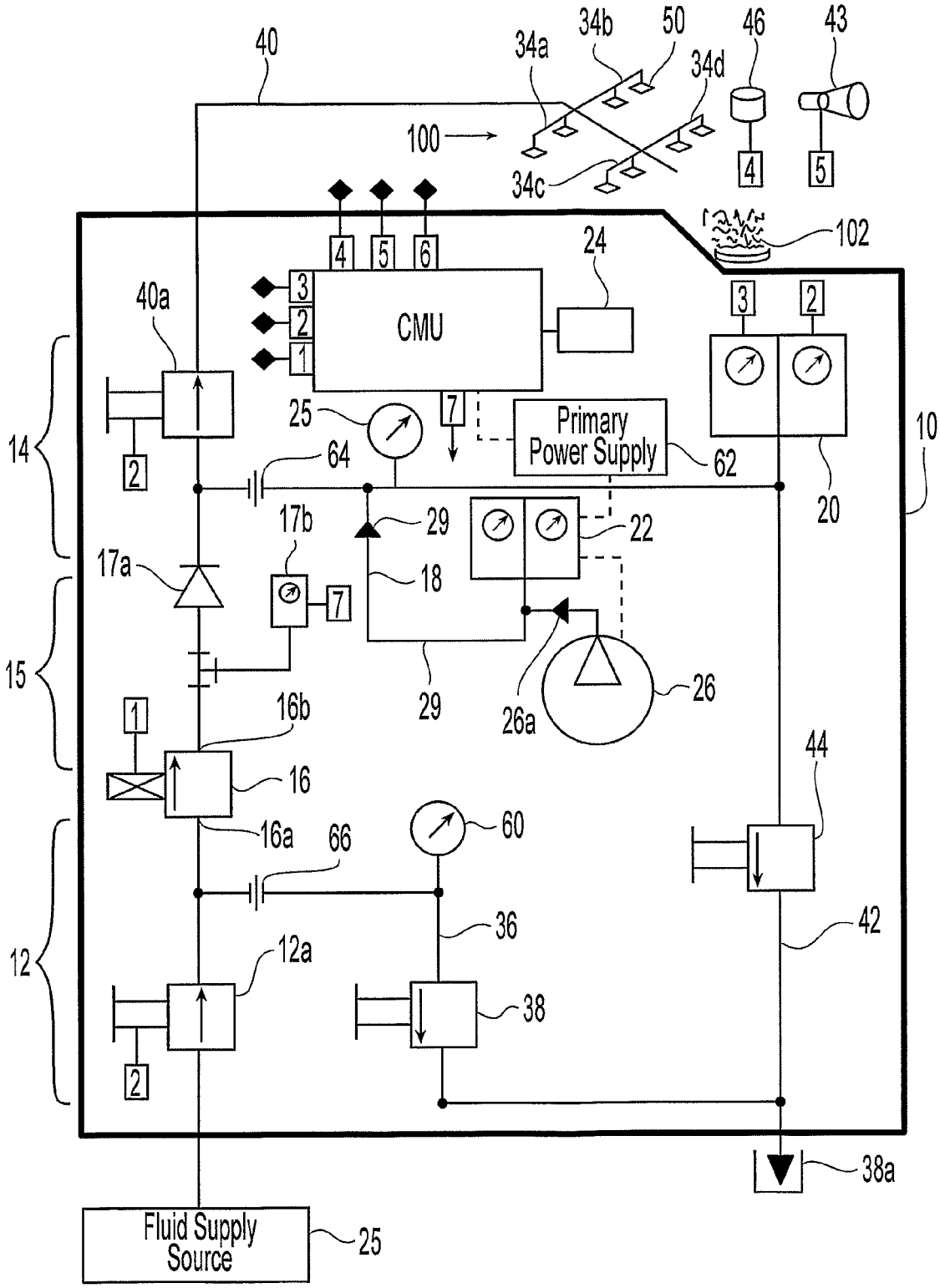
FIG. 2A is a schematic view of another preferred system that implements the control panel of FIG. 1.

The control valve 16 can be actuated between a closed state and an open state either electrically or mechanically. The control valve 16 can be a solenoid actuated controlled valve, either electrically or mechanically latched, preferably, via a magnet. Alternatively, the control valve 16 can be a mechanical diaphragm type valve that uses a pressurized latching mechanism. The system connection 14 is coupled to both the control valve 16 and a first sensor 20 so that when the control valve 16 is actuated, the system connection 14 is in fluid communication with the main connection 12. Shown schematically in FIG. 2A is an alternative embodiment of the system in which the RCP includes a fluid or waterflow indicator upstream of the system connection 14. Preferably disposed between the control valve 16 and the system connection 14 is a check valve 17*a* providing for atmospheric pipe 15 preferably coupled to the outlet of control valve 16. More specifically, the check valve 17*a* provides for the atmospheric pipe 15 when the valve 17*a* is in the normal set condition. Coupled to the pipe 15 is preferably a sensor 17*b* configured to monitor the normal atmospheric condition of the pipe 15. Upon actuation of control valve 16 and waterflow therethrough from the main connection 12, the pressure sensor 17*b* preferably provides a waterflow notification signal to the CMU.

Referring again to FIG. 2, the auxiliary pipe 18 is connected to a pressurized gas source 26 at one end of the auxiliary pipe 18 and coupled to the second sensor 22. The auxiliary pipe 18 is in fluid communication with the system connection 14 at the other end of the auxiliary pipe 18 so that the auxiliary pipe 18 and the system connection 14 are capable of being filled with pressurized gas from the pressurized gas source 26. System connection 14 can be connected to a drainpipe 42 via union 27 and a manually actuated valve 44.

Pressurized gas in excess of a specified magnitude can be vented from the auxiliary pipe 18 via a suitable relief valve (not shown). Preferably, to prevent overpressurization of the dry pipe network 100, the output of the pressurized gas source is limited to a maximum of 25 psi. Any pressure over 16 psi can be detected by first sensor 20 to provide for a fault detection of the system pressure. To ensure that pressurized gas flows unidirectionally from a supply source to the network of pipes 100, an isolation valve, e.g., a check valve 29 is provided in the connection to gas pipe 40. The check valve 29 preferably isolates the pressurized gas source 26 from the system connection. Because the pressurized gas source 26 is isolated, this prevents the gas supply source from being flooded during a system operation. Check valve 26*a* provides a secondary prevention of flooding while isolating the second sensor 22 from the gas supply source. It should be noted that any valves (29 or 26*a*) can be used in the preferred embodiments as long as the valves isolate the gas supply source 26 from the system connection. In one embodiment, the gas supply source 26 can be regulated so as to prevent any overpressurization. For example, the gas supply source 26 can be a regulated compressor that includes a control feature, such as for example, the second sensor 22 to maintain pressure in the system below 16 psi and more preferably between 10 psi. to 14 psi. More specifically, an air compressor can be coupled to a control switch that turns the compressor on upon detecting a system pressure below 10 psi. and turns the compressor off upon detecting a system pressure above 14 psi.

The first sensor 20 provides a first indicator of a magnitude of pressure in the branch pipes or body of the residential sprinklers via the system connection 14, where the system pressure is considered to be high if its magnitude is 16 psi or higher and low if its magnitude is 8 psi or lower. The second sensor 22 provides a second indicator of a magnitude of pressure in gas supply source 26 via the auxiliary pipe 18. The control panel RCP also includes a controller module unit ("CMU") preferably having a microprocessor to perform preprogrammed or programmable instructions. The CMU is powered by the primary power supply 62 or portable power supply 24. In one preferred embodiment, the RCP can provide for a back-up power supply in the event of a loss of primary or portable power supply. For example, the back-up power supply could be configured as two 7 amp hour 12 VDC batteries providing a minimum of 48 hours of standby and 15 minutes of alarm/system release power. The controller is in electronic communication with the control valve 16 and the first sensor 20 so that the controller actuates the control valve 16 towards an open position from the normally closed position as a function of various operating conditions or signals, such as, for example, a signal from the first sensor 20. A compressor or portions of the compressor that serve as the pressurized gas source 26 can be bounded by the housing 10 or located entirely outside the housing 10. As previously noted, the pressurized gas source 26 is preferably controlled directly by the second pressure sensor 22 via a direct connection between the second sensor 22, the gas source 26, and primary power supply 62. The controller can be provided with input signals indicative of at least one of heat, smoke or fire via the fire detection device 46. The controller can also output signals such as a communication signal to a monitoring station.

By virtue of the CMU, ground faults and open circuit faults on the signal circuits to fire detectors 46 or alarms 43 are supervised, thereby monitoring the fitness of the electrical devices connected remotely to the RCP. In particular, the ground faults or open circuit faults of all internal circuits such as, for example, the control valve 16, first sensor 20, manual control valve 44, manual control valve 12*a*, and control valve

40*a* are monitored or supervised by the CMU. Any of the ground or open circuit faults result in notification at the control panel RCP or the remote monitoring station.

Furthermore, the primary power supply 62 and the portable power supply unit 24 are supervised for power failure or depleted power. Upon the loss of primary power, the CMU switches over to the portable power supply unit 24. While on primary power, the portable power supply unit is recharged. Loss of power results in notification at the RCP or the remote station.

The CMU monitors the manual control valve 12*a* and control valve 40*a* are monitored by each valve is in the normally open position. Closure of either the manual valve 12*a* or control valve 40*a* results in notification at the RCP or remote station. Also, a high or low gas pressure condition, as applicable, in the system 100 via the first sensor 20 is monitored. An abnormal pressure condition results in notification.

The CMU also monitors for water leakage past control valve 16 based on a high-pressure condition reported by first sensor 20. A high or low pressure condition, i.e., an abnormal pressure condition results in notification by the CMU. The second sensor 22, however, maintains the gas pressure at a sufficient pressure to account for any drop in the gas pressure of the system as long as the pressure is within a high or low pressure values determined for the second sensor 22. Preferably, the high pressure threshold for the first sensor 20 is 16 psi or greater and the low pressure threshold is 8 psi or less. Also preferably, the high pressure threshold for the second sensor 22 is 14 psi or greater and the low pressure threshold is 10 psi or lower. While various magnitudes are referenced, it should be noted that the preferred methodologies can be altered so as to suit a desired effect, i.e., additional settings or combinations.

Referring to FIG. 2, the network of pipes being coupled to the RCP can include a riser 30 coupled to the main connection 12, which is coupled to a system connection 14. The system connection 14 can be coupled to a plurality of branch pipes 34*a*, 34*b*, 34*c*, 34*d* extending over each of the sub-divided areas. Preferably the system connection is coupled to the branch pipes 34*a*, 34*b*, 34*c*, 34*d* via the control valve 40*a* the gas pipe 40. The system connection 14 and branch pipes 34*a*, 34*b*, 34*c*, 34*d* can be filled generally with a suitable gas (e.g., air or nitrogen or mixtures thereof) so that the pipes are "dry." A pressure gauge 25 in communication with the piping network 100 provides, via system connection 14 and union 27, an indication of the system pressure. The branch pipes 34*a*, 34*b*, 34*c*, 34*d* are coupled to a quantity of residential fire sprinklers 50 located proximate the sub-divided areas in the residential dwelling unit. The quantity and type of residential fire sprinklers can be determined as set forth in copending U.S. Patent Publication No. US 20050284645, U.S. patent application Ser. No. 10/874,758, entitled "Residential Dry Sprinkler Design Method And System," filed on 24 Jun. 2004 and U.S. patent application Ser. No. 10/874,757, entitled "Residential Dry Sprinkler," filed on 24 Jun. 2004, which applications are incorporated by reference in their entireties.

In particular, the quantity and location of residential fire sprinklers for a residential dwelling unit can be determined based on a hydraulic demand of the most hydraulically remote fire sprinkler within a compartment of the residential dwelling unit. Where the residential dwelling unit can be classified as a one or two-family dwelling unit, as defined in NFPA Standard 13D (2002), the hydraulic demand of a system for the dwelling unit can be determined by assessing a hydraulic demand of a residential fire sprinkler, up to two sprinklers, for a design area of each compartment while taking into account any obstructions on the walls or ceiling. Specifically, for each compartment, one or more residential fire sprinklers (as approved by an authority having jurisdiction over fire protection design to provide sufficient fluid density) can be selected. The selected residential fire sprinklers, i.e., design sprinkler, in the selected compartment can be used to determine if the design sprinklers, up to two sprinklers, located at specified locations within any one of selected compartments, have the highest hydraulic demand of a wet pipe fire protection system for the residential dwelling unit. For each compartment, the hydraulic demand is calculated based on the location of the design sprinklers from the fluid supply source to the wet pipe network for, in some cases, all of the compartments. From the calculated hydraulic demand of some or all the compartments, the highest hydraulic demand for a particular compartment of the residential dwelling unit can be determined. This highest hydraulic demand is then compared with an actual fluid flow rate and pressure of the fluid supply. Where the highest hydraulic demand can be met by the actual fluid supply for the residential dwelling unit, the number of fire sprinklers is the sum of all the design sprinklers within the residential dwelling unit in the design of a dry pipe residential fire protection system of the dwelling unit. Thereafter, the design can be implemented, at a minimum, in accordance with installation guidelines set forth in NFPA Standard 13D (2002).

Where the residential dwelling unit can be classified as a residential dwelling unit up to and including four stories in height, as defined in NFPA Standard 13R (2002), the hydraulic demand of a system for the dwelling unit can be determined by assessing a hydraulic demand of a residential fire sprinkler, up to two sprinklers, for a design area of each compartment while taking into account any obstructions on the walls or ceiling. Specifically, for each compartment, one or more residential fire sprinklers (as approved by an authority having jurisdiction over fire protection design to provide sufficient fluid density) can be selected. The selected residential fire sprinklers, i.e., design sprinkler, in the selected compartment can be used to determine if the design sprinklers, up to four sprinklers, located at specified locations within any one of selected compartments, have the highest hydraulic demand of the fire protection system for the residential dwelling unit. For each compartment, the hydraulic demand is calculated based on the location of the design sprinklers from the fluid supply source to the wet pipe network for, in some cases, all of the compartments. From the calculated hydraulic demand of some or all the compartments, the highest hydraulic demand for a particular compartment of the residential dwelling unit can be determined. This highest hydraulic demand is then compared with an actual fluid flow rate and pressure of the fluid supply. Where the highest hydraulic demand of the residential dwelling unit can be met by the actual fluid supply for the residential dwelling unit, the number of fire sprinklers is the sum of all the design sprinklers within the residential dwelling unit in the design of a dry pipe residential fire protection system of the dwelling unit. Thereafter, the design can be implemented in accordance, at a minimum, with installation guidelines set forth in NFPA Standard 13R (2002).

Referring to FIGS. 1 and 2, a liquid supply source 25 is in fluid communication with the manual control valve 12*a* via the riser 30. The main connection 12 via union 31 is in communication with pressure gauge 60 and connected to drain line 36 that has a normally-closed drain valve 38 to drain 38*a*. A drain line 36, can be coupled in fluid communication with the main connection 12 with a normally-closed drain valve 38 to drain 38*a*. The supply control valve 16 is in fluid communication via main connection 12 with an inlet 16*a* of the control valve 16 (e.g., an electromagnetically or solenoid actuated valve). Downstream of the control valve 16, the system connection 14 is in fluid communication with an outlet 16*b* of the control valve 16. Preferably, the inlet 16*a* and outlet 16*b* has an opening with a nominal internal diameter less than two inches. A gas pipe 40 is in fluid communication with a pressurized gas source 26. Check valve 26*a* and 29 can be provided proximate the gas source 26 to prevent influx of liquid into the gas source 26. Although not shown, a pressure relief valve can also be provided downstream of the gas source 26 to prevent overpressurization of the gas pipe 40. The first sensor 20 can be used to detect a change in gas pressure in the branch lines of the piping network. The first sensor 20 can be set to one of various threshold pressures, at which threshold value will cause the first sensor 20 to provide an output signal 3. The first sensor 20 can be configured to provide a signal 3 to the CMU of the RCP, which determines when to actuate the control valve 16 via signal line 1. A fire detection device 46 that detects the occurrence of smoke, heat or flame 102 (to indicate the occurrence of a fire) is coupled to the RCP via signal line 4. The fire detection device 46 is preferably located such that the device 46 is capable of detecting the smoke, heat, or flame 102 prior to the actuation of any of the residential fire sprinklers by the smoke, heat, or flame 102. An alarm or a strobe 43 is coupled to the RCP via signal line 5. The RCP can be coupled to a remote monitoring station via signal lines 6 or through a suitable communication interface such as, for example, telephone, wireless digital communication or via an Internet connection. The RCP can be used to actuate an alarm device 43 or the control valve 16 based on a various combinations of the signals from the first sensor 20 or a fire detection device 46. For example, the RCP can actuate both the alarm device 43 and the control valve 16 based on both signals from the first sensor 20 and device 46, or from one of the signals from the first sensor 20 or device 46. A drain 42 with a normally-closed drain valve 44 can also be coupled for fluid communication with the gas pipe 40 to provide a system drain following control valve 16 and/or sprinkler system operation.

Given the preferred location of the preferably manual valves 38, 44 relative to the drain pipe 30*a* limits the system fill through the control valve 16. More specifically, any attempt to bypass the control valve 16 by, for example, opening valve 38 and/or valve 44, results in discharge through the drain line 30*a*. As seen for example in FIG. 1, the opening of the drain pipe 30*a* is located below the each of the manual valves 38, 44 such that operation of either valve 38, 44 results in water discharge through the drain pipe 30*a*. It is believed that this arrangement promotes a life safety characteristic in the RCP by eliminating manual bypass of the control valve 16 so as to encourage evacuation upon fire detection and controller operation.

In the preferred systems, each of the plurality of residential fire sprinklers 50 includes a pendant type fire sprinkler having a rated K-factor of at least nominally 4, as shown and described in *Tyco Fire & Building Products Datasheet TFP*400 *Series LFII Residential Pendent Sprinklers* 4.9 *K-factor*, which datasheet is incorporated herein by reference in its entirety; a sidewall sprinkler having a rated K-factor of at least nominally 4, as shown and described in *Tyco Fire & Building Products Datasheet TFP*410 *Series II LFII Residential Horizontal Sidewall Sprinklers* 4.2 *K-factor*, which datasheet is incorporated herein by reference in its entirety.

One preferred embodiment of the sprinkler 50' for use in a preaction, preferably double interlock, residential fire protection system having an RCP, incorporates a built-in fire detection device 46 capable of generating a signal for actuation of the control valve 16 in response to the detection of dwelling or environmental conditions indicating the likelihood of a fire event, i.e. smoke or heat. Accordingly the detector 46 can generically be considered a "fire detector" or fire detection device 46. The built-in detector 46 can facilitate signal generation before sprinkler activation in the event of a fire, and thereby signal actuation of a fluid supply control valve prior to sprinkler activation so as to ensure proper preaction system response. By ensuring that the fire detection and control valve actuation signal is generated before sprinkler activation in a non-interlocked or single-interlock preaction system (interlocked by a fire detection signal), the residential sprinkler system can maintain a true preaction response to the fire because the fluid supply control valve will have actuated and at least initiated fluid fill of the network piping before a first sprinkler activation. In the case of a double-interlock preaction system, fire detection before sprinkler activation ensures that the control valve has already received the required fire detection signal before receiving any system pressure loss signal following thermal sprinkler activation. In addition, by providing the fire detection signal to the fluid supply control valve in advance of a sprinkler activation, the water delivery time to any subsequently activated sprinkler will fall within the required fifteen second time limit. Because RCP is configured to promote life safety, the need for a manual bypass for use by an operator is unnecessary.

Figure 4:
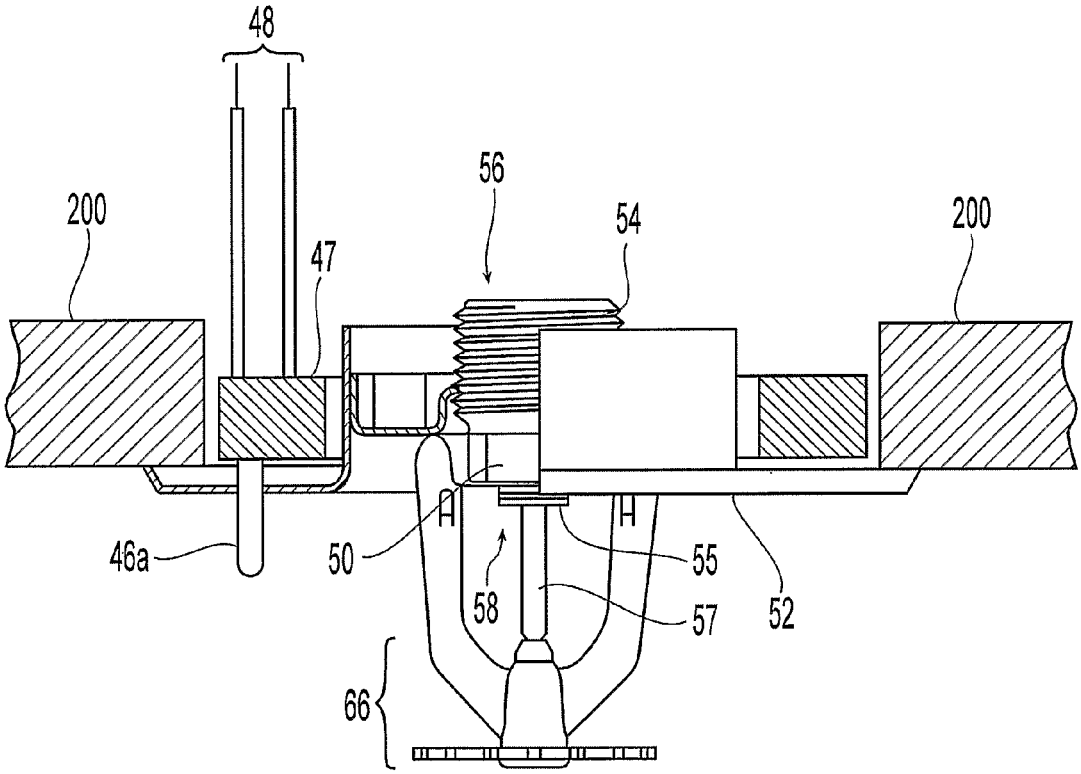
FIG. 4 is an illustrative embodiment of a sprinkler incorporating a fire detector.

As seen in FIG. 4, shown schematically is a pendant residential sprinkler 50' mounted in a ceiling 200 having a built-in detector 46. The preferred pendant residential sprinkler 50' includes a body 54 having an inlet 56, an outlet 58, and an outer thread for coupling the body inlet to a drop pipe from a branch pipe 34 in the system 100. The outlet is preferably occluded by a closure assembly 55 when the sprinkler is in a non-activated state. The closure assembly 55 can be supported adjacent the body outlet by a thermal trigger 57 such as, for example, a thermal bulb or solder fusible link. Extending distally from the outlet of the body 54 is a deflector assembly 66 which can include frame arms and a deflector plate for distributing fluid in the dwelling area. The body 54 of the sprinkler 50 is preferably disposed within a support frame 52, such as for example an escutcheon 52 for mounting the sprinkler to the ceiling 200.

Figure 4A:
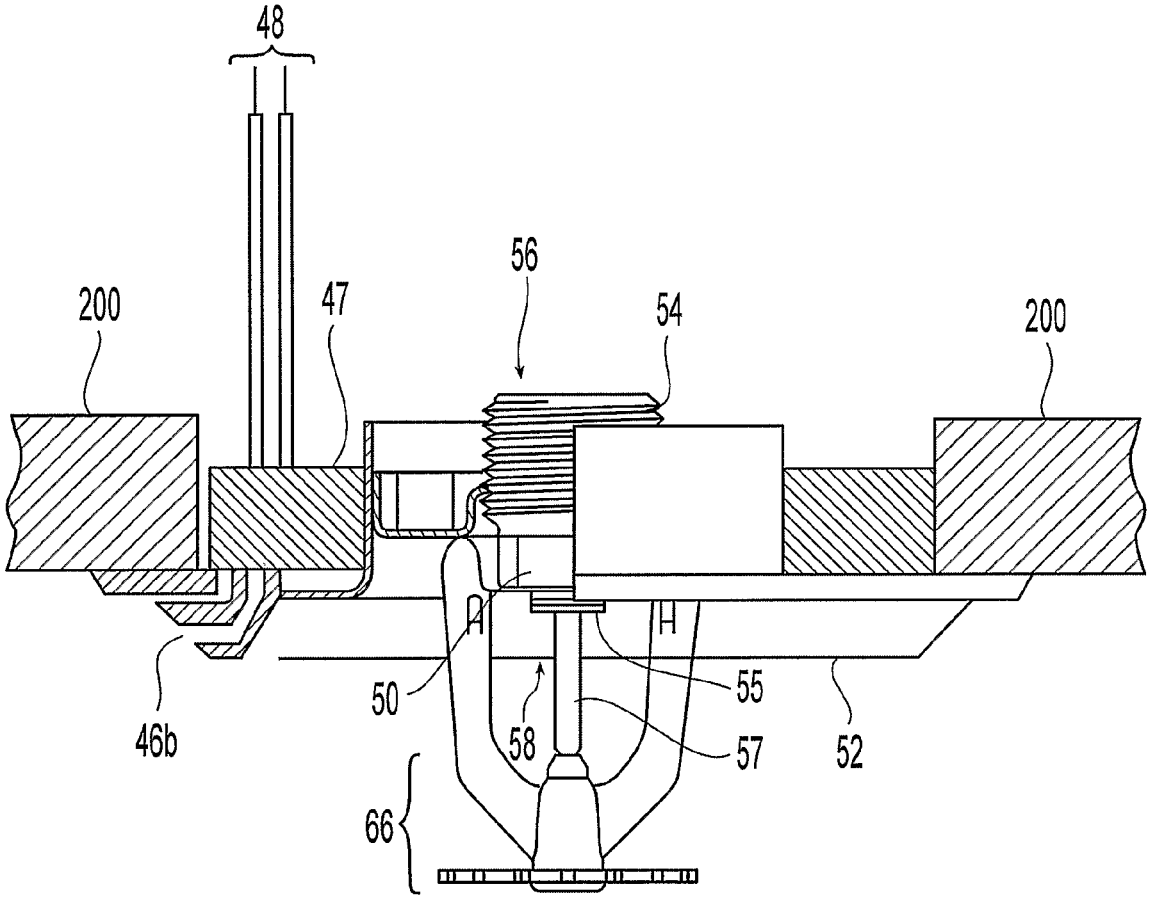
FIG. 4A is an illustrative embodiment of another sprinkler incorporating another fire detector.

The preferred sprinkler 50' incorporates a built-in detection device 46. For example, as seen in FIG. 4, incorporated in the escutcheon 52 is a heat sensor 46*a* for detecting the presence of a fire. The detection device 46 further includes means for communicating a fire detection signal to the fluid supply control valve, preferably via the RCP, to initiate valve actuation. For example, the detection device 46*a* can include a switch 47 and the necessary wiring 48 or other electronics to couple the heat sensor 46 to the RCP and communicate thereto a fire detection signal for actuating or initiating actuation of the control valve 16. The communication means can include any mode or mechanism for effectively carrying a fire detection signal to the RCP such as, for example, copper wires, fiber optics or wireless communication technology. Alternatively as seen in FIG. 4A, the escutcheon 52 can incorporate a detection device 46 in the form of a smoke detector 46*b* embodied, for example, as a plurality of louvers to detect the presence of smoke. In response the detector 46*b* can generate a signal to be communicated to the RCP of a possible fire event.

Figure 4B:
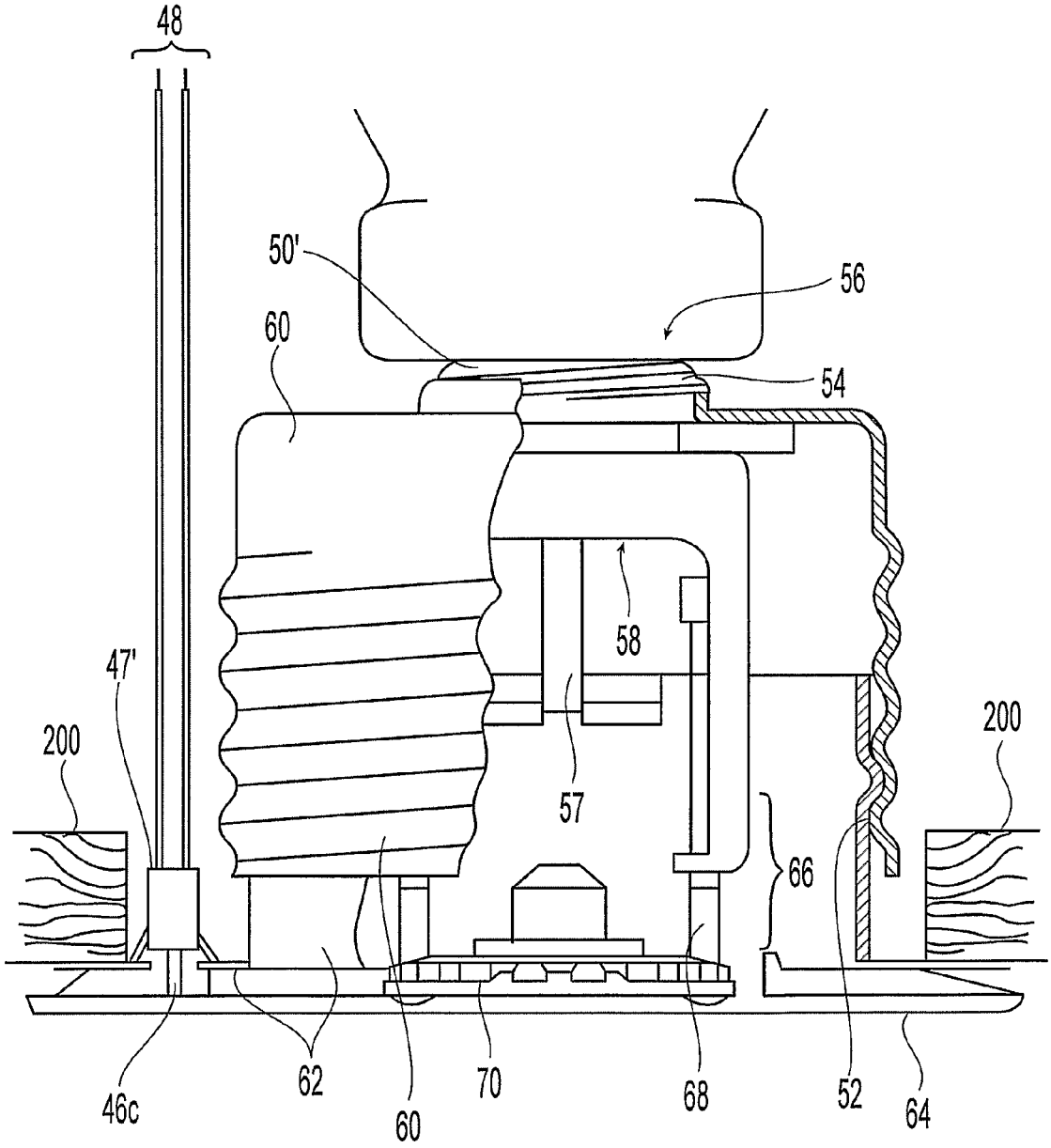
FIG. 4B is an illustrative embodiment of yet another sprinkler incorporating yet another fire detector.

One preferred embodiment of the sprinkler 50' is a concealed sprinkler as seen in FIG. 4B. The concealed sprinkler 50' includes a sprinkler support frame assembly 52 which preferably includes an outer housing 60 and a retainer assembly 62. The outer housing 60 preferably houses the body of the sprinkler 50' which can be threaded to a fitting at the end of a drop down pipe of the branch 34. Also disposed within outer housing 60 are the closure assembly 55, thermal trigger assembly 57, and deflecting assembly 66 preferably having a deflecting plate 70 and telescopic guide members 68 having axial movement relative to the outlet 58 of the body 54. The telescopic guide members 68 locate the deflector plate 70 in a first non-deployed position distal of the outlet 58 and can extend to a second deployed position distal of the first position ready for sprinkler activation.

The cover plate retainer assembly 62 is preferably threadedly engaged with the sprinkler support assembly 60. Coupled to the retainer assembly 62 is a cover plate 64 which supports and conceals the body 58 and the other operational components of the sprinkler 50' from view below the ceiling 200. The cover plate 64 can be coupled to the retainer assembly 62 by a solder beading or other thermally responsive device to support the deflector assembly in the first non-deployed position. When the solder beading is melted or triggered by a sufficient level of heat from, for example a fire, the plate 64 from the retainer assembly 62 is released thus permitting the deflector plate 70 to fall to the deployed position. Preferably built into the cover retainer assembly 62 is detection device 46 in the form of a heat detector 46*c* that indirectly detects conditions of a fire in the protection area by way of a switch 47 detecting the release of the cover plate 64. More preferably, the switch is located outside the outer housing 60 and contacts the cover plate 64. Upon detecting displacement of the plate 64, the detector 46*c* can generate a fire condition signal response to be communicated to the RCP prior to sprinkler activation via the communication means of the detector 46*c* such as, for example, wires 48 or other electronics of the built-in detector 46*c*. Although the switch 47 is illustratively shown as a mechanical switch, alternative detection mechanisms can be provide to detect displacement of the cover plate 64 from the retainer assembly 62. For example, the switch 47 can be an optical switch or infrared sensor.

Embodiments of a sprinkler using a built in detector for smoke or heat are detecting area conditions that indicate the likelihood of a fire event. Sprinklers detecting the displacement of a cover plate, thermally rated to displace in the event of a fire, are believed to more accurately signal conditions of an actual fire event. Although the various embodiments of sprinkler 50' are pictured as pendant type sprinklers, it is to be understood that the other sprinkler installation orientations can be employed including, for example, horizontal and/or sidewall sprinklers. With regard to the concealed sprinkler, although the preferred concealed sprinkler is shown with a substantially flat cover plate and telescopic deflector assembly, it should be understood that other concealed configurations can be employed such as, for example, a cover plate assembly with a substantially domed shaped cover plate or otherwise non-flat geometry. In addition, the concealed sprinkler can employ a fixed or otherwise non-telescoping deflector assembly. In summary, concealed sprinklers of varying installation orientations, varying cover plate assemblies, and deflector assemblies are possible for use with the preferred system so long as the concealed sprinkler incorporates a detector capable of detecting cover plate displacement so as to generate a signal indicating the occurrence of a fire event.

In operation of the preferred embodiments, the main connection 12, including the supply control valve 12*a* is placed in a closed position to prevent a flow of liquid to the system connection 14. Due to its configuration as a normally closed valve, i.e., a valve that occludes flow in the absence of any actuation signal, the control valve 16 occludes water from flowing through the valve 16 to the main pipe 40. Gas, on the other hand, is permitted to flow from the gas source 26 through main pipe 40, branch lines 34*a*, 34*b*, 34*c*, 34*d* and the body of each unactuated residential fire sprinklers. Once a predetermined gas pressure (e.g., 14 psig) is reached as indicated by gauge 60, the supply control valve 12*a* is opened, thereby allowing liquid to flow into the inlet 16*a* of the control valve 16 but not to main line 40. At this point, the system 100 is in a standby mode because the system 100 is now filled with pressurized gas while liquid is prevented from entering the main line 40. Manual control valve 12*a* and control valve 40*a* are monitored in the open position via signal 2 by the CMU. A pressure condition in the system 100 is monitored by first sensor 20 via signal 2 by the CMU. Thereafter, the system 100 can be controlled by the RCP in at least four different operational modes: (1) non-interlocked/non-preaction dry pipe mode; (2) non-interlock pre-action mode; (3) single interlocked; and (4) double interlocked, while providing for fault checking in all operational modes.

In the non-interlocked/non-pre-action mode, whenever a residential fire sprinkler is actuated, the gas in the main pipe 40 and branch lines 34*a*-34*d* is expelled through the actuated residential fire sprinklers. This reduction in gas pressure can be sensed by the controller CMU via the first sensor 20, which signals the control valve 16 to open, allowing liquid to flow through the main pipe 40, branch pipes 34*a* and 34*b* and to at least the actuated residential fire sprinkler, which distributes the liquid in a predetermined density over an area to be protected from a fire in a compartment of a dwelling unit within a predetermined time period elapsing from the actuation of the residential fire sprinklers. When the CMU signals the control valve 16 to open, via signal 1, the CMU also signals the alarm 43, via signal 3, to provide an alarm indicative of the actuation of a fire protection system. Additional details of these operational modes are provided in copending U.S. Patent Publication No. 20060021763, U.S. patent application Ser. No. 10/899,129, filed on Jul. 27, 2004, entitled: "Non-Interlock, Non-Pre-action Residential Dry Sprinkler Fire Protection System With Alarm;" U.S. Patent Publication No. 20060021761, U.S. patent application Ser. No. 10/899,053, filed on Jul. 27, 2004, entitled: "Non-Interlock, Non-Preaction Residential Dry Sprinkler Fire Protection System With A Releasing Control Panel," which are incorporated by reference in their entireties herein.

In the non-interlock, preaction mode, when a residential fire sprinkler is actuated, the gas in the main pipe 40 and branch pipes 34*a* and 34*b* is expelled through the actuated residential fire sprinklers. This reduction in gas pressure is detected by first sensor 20, which sends a signal to the RCP. Alternatively, if heat or flame is detected by detection device 46, a signal is sent to the RCP. Upon receipt of a signal from first sensor 20 or detection device 46, the RCP can be configured or programmed, in a preferred embodiment, to determine a suitable time frame at which to actuate control valve 16 towards an open position such as, for example, in a time frame prior to the actuation of any residential fire sprinkler so as to fill the main and branch lines with liquid (i.e., to "pre-actuate" the fire protection system). When the CMU actuates the control valve 16 to open via signal line 1, the CMU also actuates the alarm 43, via signal 3, to provide an alarm indicative of the actuation of a fire protection system. Additional details of this mode are provided in copending U.S. Patent Publication No. 20060021759, U.S. patent application Ser. No. 10/898,923, filed on Jul. 27, 2004, entitled: "Non-Interlock, Preaction Residential Dry Sprinkler Fire Protection System With A Releasing Control Panel," which application is incorporated by reference in its entirety herein.

In the single interlocked, pre-action mode, when gas pressure in the network of pipes is reduced below a threshold value due to fault in the system such as, for example, leaks in the valve, piping or defective fire sprinklers, the system is configured, i.e., "interlocked" to prevent the flow of liquid through the network of pipes, which could cause damage to the compartments of the dwelling unit. In the standby mode, the CMU, via signal 2 from sensor 20, monitors for a loss of air pressure fault. If heat or flame is detected by a detection device 46, a signal is sent to the RCP. Upon receipt of a signal from the detection device 46, the RCP can be configured or programmed, in a preferred embodiment, to determine a suitable time frame at which to actuate control valve 16 towards an open position such as, for example, in a time frame prior to the actuation of any residential fire sprinkler so as to fill the main and branch lines with liquid (i.e., to "preactuate" the fire protection system). When the CMU actuates the control valve 16 to open via signal line I, the CMU also actuates the alarm 43, via signal 3, to provide an alarm indicative of the actuation of a fire protection system. Details of such operational mode are provided in copending U.S. Patent Publication No. 20060021760, U.S. patent application Ser. No. 10/898,924, filed on Jul. 27, 2004, entitled: "Single Interlock, Preaction Residential Dry Sprinkler Fire Protection System With A Releasing Control Panel," which application is incorporated by reference in its entirety.

In the double interlocked, preaction mode, when gas pressure in the network of pipes is reduced below a threshold value due to fault in the system such as, for example, leaks in the valve, piping or defective fire sprinklers, the system is configured, i.e., "interlocked" to prevent the flow of liquid through the network of pipes, which could cause damage to the compartments of the dwelling unit. In particular, the reduction in the gas pressure is detected by first sensor 20 and provided to the RCP in the absence of any detection by the detection device 46 of a fire. In such case, the control valve 16 is interlocked by the controller due to two devices (e.g., fire detector 46 and first sensor 20), i.e., a "double-interlock" to prevent the flow of liquid through the network of pipes. When a detection device 46 faults and a signal is provided to the RCP in the absence of any air loss due to a sprinkler operation, the control valve 16 is interlocked by the controller due to two devices (e.g., fire detector 46 and first sensor 20), i.e., a "double-interlocked" to prevent the flow of liquid through the network of pipes. When both signals are received from the fire detector 46 and first sensor 20 the CMU signals the control valve 16 to open, allowing liquid to flow through the main pipe 40, branch lines 34*a* through 34*d* and to at least the actuated residential fire sprinkler. Once actuated, the residential fire sprinkler distributes the liquid in a predetermined density over an area to be protected from a fire in a compartment of a dwelling unit within a predetermined time period elapsing from the actuation of the residential fire sprinklers. Details of this operational mode are provided in copending U.S. Patent Publication No. 20060021762, U.S. patent application Ser. No. 10/899,124, filed on Jul. 27, 2004, entitled: "Double Interlock, Preaction Residential Dry Sprinkler Fire Protection System With A Releasing Control Panel," which is incorporated by reference in its entirety herein.

In any of the preaction systems, the detector 46 preferably operates before any sprinkler activation so to effect a true preaction response, and in the case of a double interlock/preaction system, facilitate water delivery within the fifteen second water delivery requirement. Accordingly, there exists an installation concern as how to employ a detector to sprinkler spacing that will facilitate detector 46 operation before any sprinkler activation. Accordingly, the inventors have discovered a methodology for locating the fire detectors relative to the sprinklers 50 to effect the appropriate operational sequence. One preferred embodiment of the detector 46 is a rate of temperature rise heat detector such as, for example, the TEPG Model T360-9302 (135° F.) Rate of Temperature Rise Heat Detector from TYCO ELECTRONICS PRODUCT GROUP. Alternatively, the detector 46 can be a fixed temperature heat detector such as, for example, the TEPG Model T360-9301 Fixed Temperature Heat Detector from TYCO ELECTRONICS PRODUCT GROUP. Generally, the rate of temperature rise heat detector is preferably used where there is substantially no expectation of a temperature rise. Use of the fixed temperature heat detector is preferably provided a compartment wherein the ambient temperature ranges between about 32° F.-100° F.

A compartment of a dwelling can be characterized by the ceiling of the compartment from which the sprinklers 50 are preferably suspended. According to the preferred methodology, at least one detector is located in any compartment in which a sprinkler 50 is located, and the detector 46 must be located within the requisite sprinkler-to-detector spacing from each sprinkler. Accordingly, one detector 46 can serve or be associated with two or more sprinklers. Moreover where sprinklers 50 are located to either side of a doorway that can be closed, detectors 46 are to be located to each side of the door. Where, the dwelling is multi-level, a detector is to be located on every level in which a sprinkler is located. Wherein the ceiling of the compartment defines a ceiling center point, the detector 46 is preferably located at the ceiling center point so as to more preferably locating the detector 46 away from any corner or dead air space of the compartment. More preferably, the detector 46 is at least about four inches away from any wall adjacent the ceiling. In addition, the detector 46 is located at a distance from air returns or heating/cooling supply vents so as to avoid any impact of the operation of these devices on the ability for the device to detect a fire. Preferably, the detector is preferably located about three feet from any of these devices.

As previously noted the location of the sprinkler is to comply with the requirements of the sprinkler to detector spacing. With regard to a rate of temperature rise heat detector, UL and ULC provides for a spacing of seventy feet (70 ft.). However, the provided spacing of UL and ULC is believed not to be sufficient for the purpose of implementing a residential preaction system. The preferred method has determined that a rate of temperature rise heat detector preferably has a sprinkler-to-detector spacing of about eight feet (8 ft.). With regard to a fixed temperature heat detector, UL and ULC provides for a spacing of seventy feet (70 ft.). However, the provided spacing of UL and ULC is not sufficient for the purpose of implementing a preaction system. The preferred method has determined that a fixed temperature heat detector preferably has a sprinkler-to-detector spacing of about three feet (3 ft.). The method further provides that where the ceiling is a sloped ceiling, the detector is preferably to be located to the high side of the sprinkler. The method further provides that where the ceiling is a sloped ceiling, the detector is preferably to be located to the high side of the sprinkler.

The preferred embodiment of the RCP may also be used in sprinkler systems described in copending U.S. Patent Publication No. 20060021766, U.S. patent application Ser. No. 10/899,131, filed on Jul. 27, 2004, entitled: "Residential Sprinkler Design Method and System With Fire Resistant Plastic Components," which is incorporated by reference in its entirety herein, and U.S. Patent Publication No. 20060021765, U.S. patent application Ser. No. 10/899,128, filed on Jul. 27, 2004, entitled: "Residential Dry Sprinkler Design Method and System With Wet Main Pipe and Fire Resistant Plastic Dry Branch Pipes," which is incorporated by reference in its entirety herein. Further description of the preferred embodiments of the RCP and its methods of use in residential sprinkler systems are described in *Tyco Fire & Building Products Datasheet TFP*480*A, Model RCP*-1 *Residential Control Panel* 1 *and* 1½ *Inch For Dry Pipe Systems*, which datasheet is incorporated herein by reference in its entirety; and *Tyco Fire & Building Products Datasheet TFP*480*B, Model RCP*-1 *Residential Control Panel* 1 *and* 1½ *Inch For Double Interlock Preaction Systems*, which datasheet is incorporated herein by reference in its entirety.

As previously discussed, one variable of concern in any residential dry or preaction sprinkler system is the water or fluid delivery delay time following sprinkler activation. Current standards require that sprinklers listed for use in a dry or preaction sprinkler system be installed so as to have a fluid delivery delay time of no greater than fifteen seconds (15 sec.). In multiple dwelling units as defined by NFPA Standards 13, 13D and/or 13R (2002) fluid delivery time is a particular concern if the main line which feeds the individual branch lines of the multiple dwelling unit is normally maintained with a pressurized gas and coupled to a fluid source by a single RCP. Requisite fluid delivery time for an activated sprinkler remote from the RCP may not be satisfied due to the need for fluid to displace the pressurized gas in the main and branch lines between the activated sprinkler and the RCP, but may be satisfied by use of appropriate pipe lengths and/or fluid flow devices.

Figure 3:
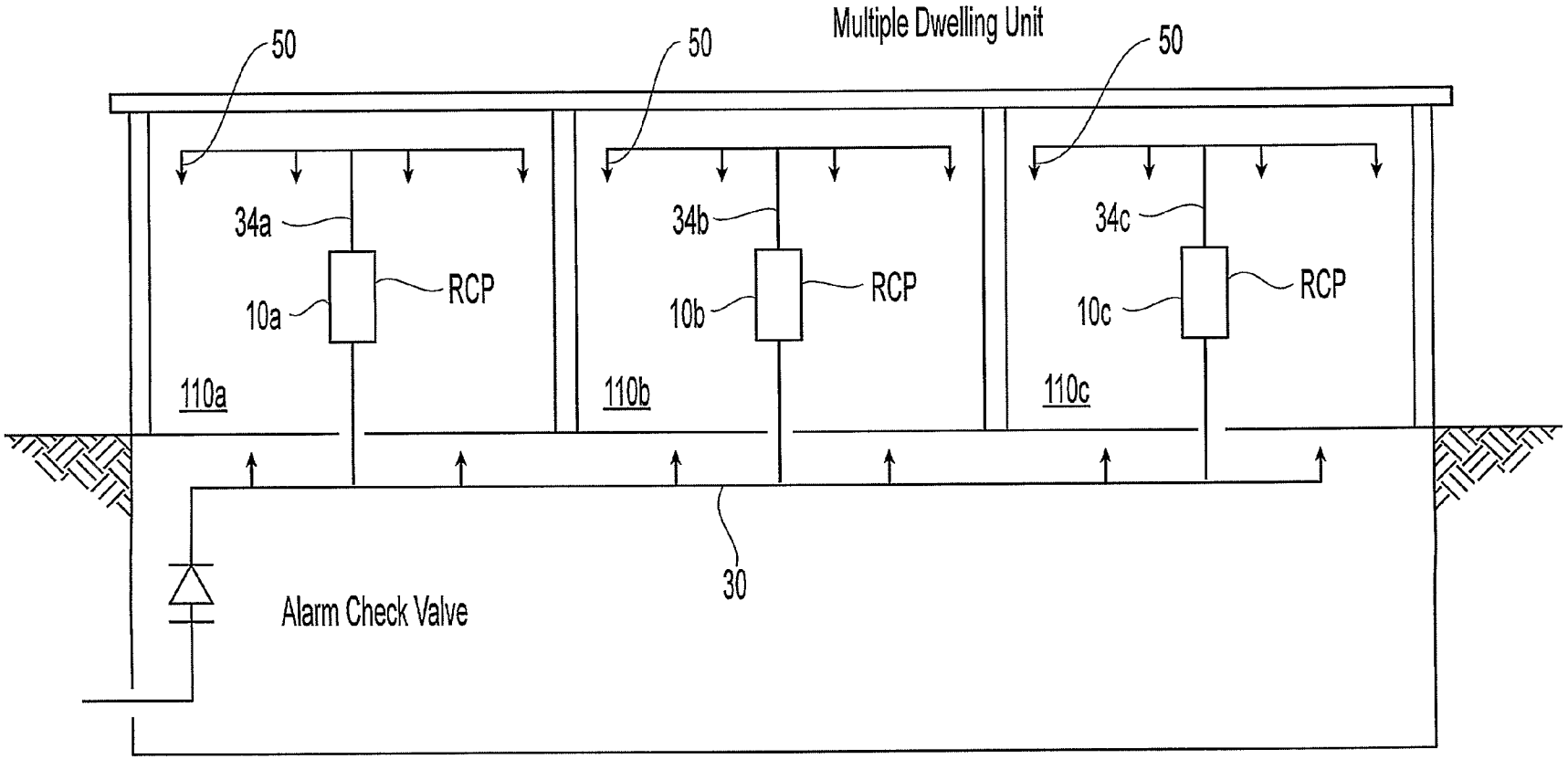
FIG. 3 is a schematic view of a multi-dwelling system using a plurality of control panels.

Alternatively, a plurality of RCP units can be used in a system to satisfy a required water delivery delay time and/or provide sectional control to the individual dwellings of a multiple dwelling unit. Shown in FIG. 3 is a schematic of a multiple dwelling unit having dwellings 110*a*, 110*b*, and 110*c*. Each of the dwellings 110*a*, 110*b*, and 110*c* include a respective branch line 34*a*, 34*b*, and 34*c* with one or more sprinklers 50 attached thereto. Running proximate to each of the dwellings, i.e. via a common stairwell, is a wet main and/or riser 30. The network of pipes can be one or more suitable types of piping such as, for example, copper, iron, or plastic piping. Preferably, various components (e.g., riser, main, branch lines and fittings) of the fire protection system are fire-resistant plastics, such as, for example, chlorinated polyvinyl chloride (CPVC). More preferably, at least the pipes and fittings of the fire protection system 100 are BlazeMaster™. CPVC pipes and fittings. And as used herein the term "fire-resistant plastic" indicates any plastic materials rated for use in a fire protection system by the NFPA, UL, or other classifying agency such as, for example, FM Approval Standard Class Number 1635 (Nov. 1989). Preferably connected to the wet main 30 are a plurality of RCP units 10*a*, 10*b*, and 10*c*, each configured as described above. Each of the RCP units 10*a*, 10*b*, 10*c* is connected to a respective branch 34*a*, 34*b*, 34*c* to provide releasing fluid control for the respective dwelling 110*a*, 110*b*, 110*c*. This configuration of using multiple RCP units can provide sectional control thereby preventing unnecessary fluid delivery to all the branches in the unit for response to a fire detection and/or pressure loss in only a single branch. Moreover, this configuration can effectively maintain the requisite fluid delivery times for every sprinkler by keeping the sprinklers relatively equidistant from the fluid source or main 30.

One preferred embodiment of a multiple RCP system in a multi-dwelling unit includes a main line 30; and a network of pipes. The network of pipes includes a plurality of branches 34*a*, 34*b*, 34*c* respectively in communication with the dwellings 110*a*, 110*b*, 110*c*. Each of the branch pipes includes at least one sprinkler 50 to discharge a fluid over the respective dwelling area within about fifteen seconds of sprinkler activation. One control panel RCP is disposed between the main line and each of the branch pipes. Each control panel is preferably in exclusive communication with the branch pipe to which it is connected thereby providing sectional control to each of the dwellings. Because each RCP is preferably in exclusive communication with a respective branch, each individual RCP can be configured for any one of at least one of a non-interlocked/non-preaction system; a non-interlocked/preaction system; a single interlocked/preaction system; and a double interlocked/preaction system.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A fire control panel for a residential dwelling unit as defined in the 2002 Edition of the National Fire Protection Association Standards 13, 13D and 13R, the fire control panel comprising:

a housing;

a control valve disposed in the housing, the valve having an inlet and an outlet, the control valve including a closure member disposed in a normally closed position to prevent fluid flow through the control valve and in an actuated position by an actuator to permit fluid flow from the inlet to the outlet through the control valve;

a main connection in communication with the inlet of the control valve, the main connection having an internal surface that defines a first flow passage along a first flow axis, the first flow passage defining a first inside diameter about the first flow axis of less than two inches;

a system connection having an internal surface that defines a second flow passage along a second flow axis, the second flow passage having a second inside diameter about the second flow axis of less than two inches, the system connection being in communication with the outlet of the control valve so that when the control valve is actuated, the system connection is in communication with the main connection;

a gas supply source that provides a pressurized gas at various pressures;

a first sensor disposed in the housing and coupled to the system connection to provide a first indicator of a magnitude of pressure in the system connection; and an isolation valve that isolates communication from the system connection to the gas supply source when the isolation valve is in a closed state to provide a system pressurized gas and an isolated pressurized gas, wherein the gas supply source provides pressurized gas in response to a magnitude of pressure of the isolated pressurized gas.

2. The fire control panel of claim 1, wherein the first and second diameter each comprises 1.5 inches.

3. The fire control panel of claim 2, further comprising an auxiliary pipe coupled to the gas supply source at one end of the auxiliary pipe and in fluid communication with the system connection at the other end of the auxiliary pipe so that the auxiliary pipe and the system connection are capable of being filled with the pressurized gas from the gas supply source.

4. The fire control panel of claim 3, further comprising a second sensor disposed in the housing and coupled to the auxiliary pipe to provide a second indicator of a magnitude of pressure in the auxiliary pipe.

5. The fire control panel of claim 4, wherein the auxiliary pipe and the main connection are coupled to a drain.

6. The fire control panel of claim 5, further comprising a controller in electrical communication with at least one of the first sensor, the second sensor, the actuator of the control valve, auxiliary inputs, and auxiliary outputs.

7. The fire control panel of claim 6, wherein the auxiliary inputs comprise respective signals indicative of at least one of heat, smoke or fire.

8. The fire control panel of claim 7, wherein the auxiliary inputs comprise a signal from a monitoring station.

9. The fire control panel of claim 8, wherein the auxiliary outputs comprise a communication signal to a monitoring station.

10. The fire control panel of claim 8, wherein the housing comprises a first volume surrounding respective portions of the control valve, auxiliary pipe, pressurized gas source, first and second sensors, main connection, controller, and the system connection.

11. The fire control panel of claim 10, wherein the housing comprises a second volume that surrounds a portable power supply unit.

12. The fire control panel of claim 1, wherein the gas supply source comprises a regulated compressor for providing the pressurized gas at various pressures and preventing overpressurization in the system.

13. The fire control panel of claim 1, wherein the control valve comprises a solenoid actuated control valve.

14. A fire control panel for a fire protection system in a residential dwelling unit as defined in the 2002 Edition of the National Fire Protection Association Standards 13, 13D and 13R, the fire control panel comprising:

a housing;

a main connection disposed in the housing and connectable to a pressurized fire-fighting fluid source;

a control valve coupled to the main connection in a normally-closed state that prevents fluid flow through the control valve;

a system connection disposed in the housing and coupled to the control valve so that when the control valve is actuated, the system connection is in fluid communication with the main connection;

an auxiliary pipe having first and second ends, the auxiliary pipe first end in fluid communication with the system connection via a first valve and the auxiliary pipe second end coupled to a pressurized gas source via a second valve so that the auxiliary pipe and the system connection are capable of being filled with pressurized gas from the pressurized gas source, the first valve of the auxiliary pipe having a closed state defining an isolated pressurized gas pressure within the auxiliary pipe;

a first sensor disposed in the housing and coupled to the system connection to provide a first indicator of a magnitude of pressure in the system connection; and a second sensor disposed in the housing and coupled to the auxiliary pipe to provide a second indicator of a magnitude of the isolated pressurized gas pressure in the auxiliary pipe to directly control the pressurized gas source.

15. The fire control panel of claim 14, further comprising a controller in electronic communication with the control valve and the first sensor so that the controller actuates the control valve towards an open position from the normally closed position as a function of a signal provided from the first sensor.

16. The fire control panel of claim 15, the pressurized gas supply source being operable to provide pressurized gas based on a signal from the second sensor.

17. The fire control panel of claim 16, wherein the main connection comprises an internal surface that defines a first flow passage along a first flow axis, the first flow passage having a first cross-sectional area generally orthogonal to the first flow axis of less than 4.9 square inches; and wherein the system connection comprises an internal surface that defines a second flow passage along a second flow axis, the second flow passage having a second cross-sectional area generally orthogonal to the second flow axis of less than 4.9 square inches.

18. The fire control panel of claim 17, wherein the first cross-sectional area and the second cross-sectional area each comprises a cross-sectional area selected from a group comprising one of 1.8 square inches and 3.1 square inches.

19. The fire control panel of claim 17, the second valve comprising a check valve that permits flow from the pressurized gas source to the auxiliary pipe and prevents flow from the auxiliary pipe to the pressurized gas source.

20. The fire control panel of claim 17, wherein the auxiliary pipe and the main connection are coupled to a drain pipe.

21. The fire control panel of claim 15, wherein the controller is in electrical communication with a solenoid actuator of the control valve, auxiliary inputs, and auxiliary outputs.

22. The fire control panel of claim 21, wherein the auxiliary inputs comprise respective signals indicative of at least one of heat, smoke or fire.

23. The fire control panel of claim 21, wherein the auxiliary inputs comprise a signal from a monitoring station.

24. The fire control panel of claim 21, wherein the auxiliary outputs comprise a communication signal to a monitoring station.

25. The fire control panel of claim 14, wherein the housing comprises a first volume that surround respective portions of the control valve, auxiliary pipe, pressurized gas source, first and second sensors, main connection, controller, and the system connection.

26. The fire control panel of claim 25, wherein the housing comprises a second volume that surrounds a portable power supply unit.

27. A method of determining fault in a residential fire control system having a network of dry pipes in fluid communication with respective bodies of residential fire sprinklers and a control panel, the control panel having a housing, a control valve coupled to a main connection, a system connection coupled to the control valve, an auxiliary pipe coupled to a gas supply source at one end of the auxiliary pipe and in fluid communication with the system connection at the other end of the auxiliary pipe, the control panel being connected to a fire detection device, a first sensor, and a second sensor, the method comprising:

isolating a pressurized gas within the auxiliary pipe from a network gas pressure to define an isolated pressurized gas pressure in the auxiliary pipe;

sensing a value of the isolated pressurized gas pressure with the second sensor, the second sensor directly connected to the auxiliary pipe;

operating the gas supply source based on the isolated pressurized gas pressure in the auxiliary pipe; and indicating a fault condition in the fire protection system when the network gas pressure is below a first magnitude using the first sensor.

28. The method of claim 27, further comprising:
interlocking the control valve.

29. The method of claim 27, further comprising:
operating the gas supply source to raise the network gas pressure to a magnitude at least equal to the first magnitude.

30. The method of claim 27, further comprising:
opening the control valve in response to an activation of a fire detection device and a change in the network gas pressure.

31. The method of claim 27, further comprising:
indicating a fault condition in the fire protection system when a gas pressure in the system is above a second magnitude using at least one of the first and second sensors.

32. The method of claim 27, further comprising:
indicating a fault condition in the fire protection system when there is a communication fault between the control panel and at least one of the fire detection device, the first sensor, and a second sensor.

33. The method of claim 32, wherein the communication fault includes at least one of a ground fault and an electrical fault.

34. The method of claim 27, wherein indicating a fault condition when the network gas pressure is below the first magnitude comprises communicating a signal between the control panel and at least one of the first and second sensors.

35. The method of claim 27, further comprising:
indicating detection of a fire by the fire detection device.

36. The method of claim 35, wherein detecting a fire includes detecting at least one of heat and smoke.

37. The method of claim 35, wherein indicating detection of a fire includes opening the control valve.

38. The method of claim 27, further comprising:
opening the control valve after the occurrence of at least one of the network gas pressure falling below the first magnitude, an indication of a communication fault, and an indication of a detection of a fire.

39. A residential fire control panel comprising:
a housing;
a first manual control valve and a second manual control valve located within the housing, the first and second manual control valves each having an outlet and an inlet, the inlet of the first manual control valve being configured for communication with a fluid main, the outlet of the second manual control valve being configured for communication with a network of pipes having at least one sprinkler;
a normally-closed solenoid control valve disposed within the housing between the first and second manual control valves to provide a first communication between the outlet of the first manual control valve and the inlet of the second manual control valve, the first communication maintaining a fluid pressure provided via the fluid main;
a drain line coupled to at least one normally-closed drain valve communicating with the solenoid control valve to provide a second communication between the outlet of the first manual control valve and the inlet of the second manual control valve;
a compressed air conduit in communication with the inlet of the second manual control valve via an isolation valve that isolates a pressure in the compressed air conduit from the inlet of the second manual control valve when the isolation valve is in a closed state;
an air compressor disposed within the housing in communication with the compressed air conduit to provide a supply of pressurized air to the compressed air conduit;
a first pressure switch to detect an air the isolated pressure in the compressed air conduit outside a first range of pressures and a second pressure switch to maintain the supply of pressurized air in a second range of pressures, the second pressure switch being in communication with the air compressor and controlling operation of the air compressor based on a status of the first pressure switch; and
a controller coupled to a power source and having at least one input for receiving a low pressure signal and a high pressure signal, the controller being in communication with at least one alarm to actuate the at least one alarm upon the controller receiving a signal of at least one of the low and high pressure signal.

40. The control panel of claim 39, wherein the controller is in communication with the solenoid control valve so as to actuate the solenoid control valve upon receiving a low pressure signal so as to define a control panel for a dry pipe system.

41. The control panel of claim 39, wherein the controller is in communication with the first pressure switch and the solenoid control valve so as to actuate the solenoid control valve following receipt of a low pressure signal from the first pressure switch detecting a pressure below the first range of pressures so as to define a control panel for a non-interlock preaction system.

42. The control panel of claim 39, wherein the controller includes at least one input for receiving a fire detection signal.

43. The control panel of claim 42, wherein the controller is in communication with the solenoid control valve so as to actuate the solenoid control valve following receipt of at least one of the fire detection signal and a low pressure signal from the first pressure switch detecting a pressure below the first range of pressures so as to define a non-interlock preaction system.

44. The control panel of claim 42, wherein the controller is in communication with the solenoid control valve so as to actuate the solenoid control valve following receipt of the fire detection signal so as to define a single-interlock preaction system.

45. The control panel of claim 42, wherein the controller is in communication with the solenoid control valve so as to actuate the solenoid control valve following receipt of the fire detection signal and a low pressure signal from the first pressure switch detecting a pressure below the first range of pressures so as to define a double-interlock preaction system.

46. The control panel of claim 39, wherein the housing includes a monitoring station in communication with the controller to communicate at least one of a power level of the power supply, alarm actuation, solenoid control valve actuation, a low pressure signal, a high pressure signal, and a communication fault signal.

47. The control panel of claim 42, wherein the housing includes a monitoring station in communication with the controller to communicate at least one of a power level of the power supply, alarm actuation, solenoid control valve actuation, a low pressure signal, high pressure signal, fire detection and a communication fault signal.

48. The control panel of claim 39, wherein the first range of pressures range from about eight pounds per square inch to about sixteen pounds per square inch (8 psi.-16 psi.).

49. The control panel of claim 39, wherein the second range of pressures range from about ten pounds per square inch to about fourteen pounds per square inch (10 psi.-14 psi.).

50. The control panel of claim 39, wherein the inlet of the first manual control valve and the outlet of the second manual control valve has a nominal size ranging from about one inch to about one and one-half inch (1 in.-1½ in.).

51. A method of using a residential fire control panel having a housing disposed between a main source of pressurized fluid and a branch pipe of a residential sprinkler system, the method comprising:

isolating a gas source from the branch pipe with an auxiliary pipe and an isolation valve both disposed between the gas source and the branch pipe to define a pressurized gas pressure of a pressurized gas within the auxiliary pipe when the isolation valve is in a closed state;

initiating a flow of the pressurized gas through the isolation valve in response to the pressurized gas pressure;

pressurizing the branch pipe to a first magnitude with the pressurized gas from the gas source located within the housing;

sensing a low pressure in the branch pipe from a sensor disposed in the housing, the low pressure being a second magnitude of pressure below the first magnitude;

controlling introduction of fluid from the main source into the branch pipe through the control panel in response to the low pressure, the fluid passing through three open valves connected in series to provide a pressurized communication between the main source and the branch pipe, the pressurized communication being the only available pathway for the introduction of pressurized fluid from the main source to the branch pipe.

52. The method of claim 51, wherein the three open valves include a first manual control valve, a second manual control valve and a solenoid control valve disposed between the first and second manual control valve.

53. The method of claim 51, wherein the residential sprinkler system defines a dry pipe sprinkler system, wherein the sensing a low pressure includes sensing the low pressure at a controller disposed in the housing and wherein further the controlling introduction of fluid includes actuating a solenoid control valve in communication with the controller.

54. The method of claim 51, wherein the residential sprinkler system defines a non-interlocked preaction system, wherein the sensing a low pressure includes sensing the low pressure and generating a low pressure signal at a pressure switch disposed in the housing, communicating the signal to a controller disposed in the housing, and wherein further the controlling introduction of fluid includes actuating a solenoid control valve in communication with the controller in response to the low pressure signal.

55. The method of claim 51, wherein the controlling introduction includes at least one of single and double interlocking the introduction of the fluid with detecting a fire.

56. The method of claim 55, wherein single interlocking the introduction of the fluid with detecting a fire includes receiving a fire detection signal at a controller in communication with a solenoid control valve and actuating the solenoid control valve in response to the fire detection signal.

57. The method of claim 55, wherein sensing the low pressure includes sensing the low pressure at a pressure switch disposed in the housing, communicating a low pressure signal from the pressure switch to a controller in communication with a solenoid control valve and wherein double interlocking the introduction of the fluid includes receiving a fire detection signal and the low pressure signal at the controller and actuating the solenoid control valve in response to the fire detection and low pressure signals.

58. A residential unit fire protection system for a residential dwelling unit having at least one dwelling as defined in the 2002 Edition of the National Fire Protection Association Standards 13, 13D and 13R, the fire protection system comprising:

a fluid supply source along a main line;

a network of pipes including a first branch in communication with the at least one dwelling the first branch including at least one sprinkler to discharge a fluid over the at least one dwelling area within about fifteen seconds of sprinkler activation;

at least one fire control panel disposed between the main line and the branch pipe, the at least one fire control panel comprising:

a housing;

a gas source disposed in the housing;

a normally closed control valve disposed in the housing, the control valve having an inlet and an outlet;

a main connection providing communication between the main line and the inlet of the control valve via a first manual control valve, the main connection having an internal surface that defines a first flow passage along a first flow axis, the first flow passage defining a first inside diameter about the first flow axis of less than two inches;

a system connection having an internal surface that defines a second flow passage along a second flow axis, the system connection providing communication between the first branch pipe and the outlet of the control valve via a second manual control valve to provide controlled fluid communication between the first branch pipe and the fluid supply source;

a drain line communicating with the normally closed control valve at a point disposed between the first and second manual control valves;

an auxiliary pipe with first and second ends, the auxiliary pipe first end communicating with the system connection via a first isolation valve, the auxiliary pipe second end coupled to the gas source via a second isolation valve, the first and second isolation valves defining an isolated auxiliary pipe pressure therebetween when the first isolation valve is in a closed state, the gas source providing pressurized gas in response to a magnitude of pressure of the isolated auxiliary pipe pressure; and a sensor disposed in the housing and coupled to the system connection to detect a threshold reduction in the system pressure.

59. The system of claim 58, wherein the sensor is in communication with the normally closed control valve to actuate the normally closed control valve upon detecting a reduction in system pressure to define a non-interlock/non-preaction mode.

60. The system of claim 58, further comprising at least one fire detector disposed in the at least one dwelling and in communication with the at least one fire control panel.

61. The system of claim 60, wherein the at least one fire detector is one of a heat detector and smoke detector.

62. The system of claim 60, wherein the at least one fire detector is incorporated into the at least one sprinkler.

63. The system of claim 58, wherein the at least one sprinkler is a concealed sprinkler having a cover plate engaged with a retainer plate assembly.

64. The system of claim 63, wherein the fire detector is built into the retainer plate assembly and detects disengagement of the cover plate and the retainer plate.

65. The system of claim 58, wherein the sensor and a detector are in communication with the control valve so that upon at least one of the sensor detecting a reduction in pressure and the detector detecting a fire, the control valve is actuated to define a non-interlock/preaction mode.

66. The system of claim 60, wherein the detector is in communication with the control valve so that upon the detector detecting a fire, the control valve is actuated to define an interlock/preaction mode.

67. The system of claim 60, wherein the sensor and the detector is in communication with the control valve so that upon the sensor detecting a reduction in pressure and the detector detecting a fire, the control valve is actuated to define a double interlock/preaction mode.

68. The system of claim 58, wherein the dwelling unit includes at least a second dwelling and the network of pipes includes a second branch pipe having at least one sprinkler in communication with the at least second dwelling, the system further comprising at least a second fire control panel disposed between the main line and the second branch pipe, the first control panel being in exclusive communication with the first branch and the second fire control panel being in exclusive communication with the second branch so as to provide sectional control to the first and at least second dwellings.

69. The system of claim 68, wherein the at least second fire control panel comprises:

a housing;

a normally closed control valve disposed in the housing, the control valve having an inlet and an outlet;

a main connection providing communication between the main line and the inlet of the control valve, the main connection having an internal surface that defines a first flow passage along a first flow axis, the first flow passage defining a first inside diameter about the first flow axis of less than two inches;

a system connection having an internal surface that defines a second flow passage along a second flow axis, the system connection providing communication between the second branch pipe and the gas source to provide a system pressure to the second branch pipe, the system connection further providing communication between the second branch pipe and the outlet of the control valve to provide controlled fluid communication between the network of pipes and the fluid supply source; and a sensor disposed in the housing and coupled to the system connection to detect a threshold reduction in the system pressure.

70. The system of claim 68, wherein the first control panel defines at least one of a non-interlocked/non-preaction system; a non-interlocked/preaction system; a single interlocked/preaction system; and a double interlocked/preaction system and the second control panel defines at least one of a non-interlocked/non-preaction system; a non-interlocked/preaction system; a single interlocked/preaction system; and a double interlocked/preaction system independent of the first control panel.

71. The system of claim 68, wherein at least one of the first and second control panel is in communication with at least one fire detector built into at least one sprinkler of the respective first and second branch, and the other of the first and second control panels is in communication with a fire detector spaced from the at least one sprinkler of the respective other of the first and second branch.

72. The system of claim 58, further comprising a flow indication device disposed between the normally closed control valve and the system connection.

73. The system of claim 72, wherein the flow indication device comprises a check valve coupled to a pipe having a normal set atmospheric condition and a flow sensor coupled to the pipe to sense flow through the pipe.

74. A residential unit fire protection system for a residential dwelling unit having at least one dwelling as defined in the 2002 Edition of the National Fire Protection Association Standards 13, 13D and 13R, the fire system comprising:

a fluid supply source along a main line;

a network of pipes including a first branch in communication with the at least one dwelling the first branch including at least one sprinkler to discharge a fluid over the at least one dwelling area within about fifteen seconds of an activation of the at least one sprinkler;

at least one fire control panel disposed between the main line and the branch pipe, the fire control panel having a pressurized gas source communicating with the network of pipes via an auxiliary pipe, an isolation valve disposed between the auxiliary pipe and the network of pipes that defines when in a closed state an isolated pressurized gas pressure of the pressurized gas in the auxiliary pipe, a switch controlling an operational status of the pressurized gas source based on the isolated pressurized gas pressure; and at least one detector spaced from the at least one sprinkler at a defined sprinkler-to-detector spacing, the at least one detector generating a signal before an activation of any one of the at least one sprinkler.

75. The system of claim 74, wherein the at least one detector is a rate of temperature rise heat detector and the sprinkler-to-detector spacing is about eight feet.

76. The system of claim 74, wherein the at least one detector is a fixed temperature heat detector and the sprinkler-to-detector spacing is about three feet.

77. The fire control panel of claim 1, further comprising a flow indication device disposed between the control valve and the system connection.

78. The fire control panel of claim 77, wherein the flow indication device comprises a check valve coupled to a pipe having a normal set atmospheric condition and a sensor coupled to the pipe to sense flow through the pipe.

79. The control panel of claim 14, further comprising a flow indication device disposed between the control valve and the system connection.

80. The control panel of claim 39, further comprising a flow indication device disposed between the control valve and the system connection.

* * * * *

UNITED STATES PATENT AND TRADEMARK OFFICE

CERTIFICATE OF CORRECTION

PATENT NO. : 8,297,370 B2
APPLICATION NO. : 11/916419
DATED : October 30, 2012
INVENTOR(S) : Wilkins et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 835 days.

Signed and Sealed this
Twenty-sixth Day of August, 2014

Michelle K. Lee

Michelle K. Lee
*Deputy Director of the United States Patent and Trademark Office*